US012564221B2

(12) United States Patent
Aller et al.

(10) Patent No.: US 12,564,221 B2
(45) Date of Patent: Mar. 3, 2026

(54) AEROSOL DELIVERY DEVICE WITH DEFLECTABLE OR COLLAPSIBLE HOUSING

(71) Applicant: R.J. Reynolds Tobacco Company, Winston-Salem, NC (US)

(72) Inventors: Jared Aller, Winston-Salem, NC (US); Karen H. Cleckley, Kernersville, NC (US); Thaddeus Jackson, Summerfield, NC (US); Vic Pramono, Campbell, CA (US); Christina Tapp, Walnut Creek, CA (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 464 days.

(21) Appl. No.: 18/081,308

(22) Filed: Dec. 14, 2022

(65) Prior Publication Data

US 2024/0196972 A1 Jun. 20, 2024

(51) Int. Cl.
*A24F 40/42* (2020.01)

(52) U.S. Cl.
CPC ..... *A24F 40/42* (2020.01)

(58) Field of Classification Search
None
See application file for complete search history.

(56) References Cited

U.S. PATENT DOCUMENTS 1,464,300 A 8/1923 Taff
1,505,655 A 8/1924 Marek
1,541,891 A 6/1925 Becker
1,607,132 A 11/1926 Shichigoro
1,613,545 A 1/1927 Teigen
1,941,531 A 1/1934 Blankenship
1,978,601 A * 10/1934 Reusch ..... A24F 13/10 131/182
2,008,433 A 7/1935 Ashour
(Continued)

FOREIGN PATENT DOCUMENTS

FR 2686671 A1 * 7/1993 ..... F16D 3/845
JP 2002034543 2/2002
(Continued)

OTHER PUBLICATIONS

English Machine Translation of Harnist FR2686671 (Year: 1993).*

*Primary Examiner* — Michael H. Wilson
*Assistant Examiner* — Daniel Edward Vakili
(74) *Attorney, Agent, or Firm* — Womble Bond Dickinson (US) LLP

(57) ABSTRACT

The present disclosure is directed to a holder for use with a removable substrate cartridge. In one implementation, the holder comprises a main body that includes a collapsible section configured to collapse in an axial direction into an ejecting position when an ejecting force is applied to the main body. The collapsible portion is further configured to return to the use position when no ejecting force is applied to the main body. In another implementation, the holder comprises a main body that includes at least one deflectable portion configured to rotate relative to the remaining main body into an ejecting position when an ejecting force is applied to the main body. The at least one deflectable portion is further configured to return to the use position when no ejecting force is applied to the main body.

10 Claims, 14 Drawing Sheets

(56) References Cited

U.S. PATENT DOCUMENTS

| | | | | |
|---|---|---|---|---|
| 2,373,629 | A | 4/1945 | Daugherty | |
| 2,455,492 | A | 12/1948 | Jackson | |
| 2,502,831 | A * | 4/1950 | Daze | A24F 13/10 131/182 |
| 2,541,837 | A | 2/1951 | Schroff | |
| 2,679,848 | A * | 6/1954 | Kirsten | A24F 13/10 131/182 |
| 2,701,571 | A | 2/1955 | Dittrich | |
| 2,711,176 | A | 6/1955 | Randey | |
| 2,779,340 | A | 1/1957 | Lee | |
| 2,953,136 | A | 9/1960 | Dahly | |
| 3,155,099 | A | 11/1964 | Minchin | |
| 3,181,538 | A | 5/1965 | Mario | |
| 3,685,520 | A | 8/1972 | Chernack | |
| 4,708,151 | A | 11/1987 | Shelar | |
| 4,714,082 | A | 12/1987 | Banerjee et al. | |
| 4,966,171 | A | 10/1990 | Serrano et al. | |
| 4,991,606 | A | 2/1991 | Serrano et al. | |
| 5,040,552 | A | 8/1991 | Schleich et al. | |
| 5,060,676 | A | 10/1991 | Hearn et al. | |
| 5,076,296 | A | 12/1991 | Nystrom et al. | |
| 5,159,940 | A | 11/1992 | Hayward et al. | |
| 5,178,165 | A | 1/1993 | DeFelice | |
| 5,240,012 | A | 8/1993 | Ehrman et al. | |
| 5,592,955 | A | 1/1997 | Keritsis | |
| 5,595,577 | A | 1/1997 | Bensalem et al. | |
| 5,692,525 | A | 12/1997 | Counts et al. | |
| 5,845,649 | A | 12/1998 | Saito et al. | |
| 6,006,757 | A | 12/1999 | Lichtenberg | |
| 6,053,176 | A | 4/2000 | Adams et al. | |
| 6,164,287 | A | 12/2000 | White | |
| 6,311,694 | B1 | 11/2001 | Nichols et al. | |
| 6,345,625 | B1 | 2/2002 | Chew | |
| 6,371,127 | B1 | 4/2002 | Snaidr et al. | |
| 6,431,177 | B1 | 8/2002 | Sieggen et al. | |
| 6,532,965 | B1 | 3/2003 | Abhulimen et al. | |
| 6,615,843 | B2 | 9/2003 | Pera | |
| 6,748,955 | B2 | 6/2004 | Snaidr et al. | |
| 7,080,649 | B2 | 7/2006 | Hcu | |
| 7,503,330 | B2 | 3/2009 | Borschke et al. | |
| 7,600,517 | B1 | 10/2009 | Holzrichter | |
| 7,624,739 | B2 | 12/2009 | Snaidr et al. | |
| 8,061,361 | B2 | 11/2011 | Maeder et al. | |
| 8,151,803 | B2 | 4/2012 | Inagaki | |
| 8,302,611 | B2 | 11/2012 | Rowley | |
| 8,528,567 | B2 | 9/2013 | Hajaligol | |
| 8,616,217 | B2 | 12/2013 | Tsurizumi et al. | |
| 8,776,803 | B2 | 7/2014 | Tarora et al. | |
| 8,863,754 | B2 | 10/2014 | Renaud et al. | |
| 8,915,255 | B2 | 12/2014 | Poget et al. | |
| 9,078,473 | B2 | 7/2015 | Worm et al. | |
| 9,149,072 | B2 | 10/2015 | Conner et al. | |
| 9,220,301 | B2 | 12/2015 | Banerjee et al. | |
| 9,282,769 | B2 | 3/2016 | Mishra et al. | |
| 9,301,546 | B2 | 4/2016 | Thomas et al. | |
| 9,332,784 | B2 | 5/2016 | Banerjee et al. | |
| 9,439,453 | B2 | 9/2016 | Conner et al. | |
| 9,532,591 | B2 | 1/2017 | Mironov | |
| 9,549,572 | B2 | 1/2017 | Dincer et al. | |
| 9,609,893 | B2 | 4/2017 | Novak, III et al. | |
| 9,629,393 | B2 | 4/2017 | Stolz et al. | |
| 9,693,587 | B2 | 7/2017 | Plojoux | |
| 9,717,273 | B2 | 8/2017 | Poget et al. | |
| 9,730,468 | B2 | 8/2017 | Poget et al. | |
| 9,801,412 | B2 | 10/2017 | Grant | |
| 9,894,930 | B2 | 2/2018 | Bonici et al. | |
| 9,918,494 | B2 | 3/2018 | Mironov et al. | |
| 9,930,915 | B2 | 4/2018 | Worm et al. | |
| 9,943,114 | B2 | 4/2018 | Batista | |
| 9,961,939 | B2 | 5/2018 | Reevell | |
| 10,022,014 | B2 | 7/2018 | Mateos Martin et al. | |
| 10,034,493 | B2 | 7/2018 | Akiyama et al. | |
| 10,062,015 | B2 | 8/2018 | Besehanic | |
| 10,064,428 | B2 | 9/2018 | Swepston et al. | |
| 10,064,478 | B2 | 9/2018 | Brooks | |
| 10,082,015 | B2 | 9/2018 | Williams et al. | |
| 10,102,013 | B2 | 10/2018 | Preston et al. | |
| 10,111,463 | B2 | 10/2018 | Batista | |
| 10,132,009 | B2 | 11/2018 | Chou et al. | |
| 10,159,277 | B2 | 12/2018 | Bonnely | |
| 10,212,014 | B2 | 2/2019 | Qu et al. | |
| 10,212,968 | B2 | 2/2019 | Mironov et al. | |
| 10,222,015 | B2 | 3/2019 | Chien | |
| 10,262,017 | B2 | 4/2019 | Wolge | |
| 10,291,991 | B2 | 5/2019 | Shan et al. | |
| 10,301,990 | B2 | 5/2019 | De Smet et al. | |
| 10,302,018 | B2 | 5/2019 | Venter | |
| 10,312,017 | B2 | 6/2019 | Huang et al. | |
| 10,398,168 | B2 | 9/2019 | Maiwald et al. | |
| 10,470,491 | B2 | 11/2019 | Sutton et al. | |
| 10,492,526 | B2 | 12/2019 | Sampson et al. | |
| 10,524,503 | B2 | 1/2020 | Florack et al. | |
| 10,827,780 | B2 | 11/2020 | Swepston et al. | |
| 2008/0047570 | A1 | 2/2008 | Plank | |
| 2009/0065011 | A1 | 3/2009 | Maeder et al. | |
| 2011/0083674 | A1 | 4/2011 | Karpinsky | |
| 2013/0133675 | A1 | 5/2013 | Shinozaki et al. | |
| 2013/0167850 | A1 | 7/2013 | Al-Aawar | |
| 2013/0228190 | A1 | 9/2013 | Weiss et al. | |
| 2014/0048085 | A1 | 2/2014 | Cox | |
| 2015/0034100 | A1 | 2/2015 | Park et al. | |
| 2015/0040924 | A1 | 2/2015 | Mironov et al. | |
| 2015/0296882 | A1 | 10/2015 | Mironov et al. | |
| 2015/0342254 | A1 | 12/2015 | Mironov et al. | |
| 2016/0007648 | A1 | 1/2016 | Sutton et al. | |
| 2016/0007649 | A1 | 1/2016 | Sampson et al. | |
| 2016/0120216 | A1 | 5/2016 | Mironov et al. | |
| 2016/0135495 | A1 | 5/2016 | Poget et al. | |
| 2016/0174609 | A1 | 6/2016 | Mironov | |
| 2016/0192704 | A1 | 7/2016 | Bonnely | |
| 2016/0316816 | A1 | 11/2016 | Lavanchy et al. | |
| 2016/0360785 | A1 | 12/2016 | Bless et al. | |
| 2017/0000189 | A1 | 1/2017 | Mironov et al. | |
| 2017/0055577 | A1 | 3/2017 | Batista | |
| 2017/0055578 | A1 | 3/2017 | Oda et al. | |
| 2017/0164654 | A1 | 6/2017 | Ademe | |
| 2017/0196261 | A1 | 7/2017 | Borges De Couraca et al. | |
| 2017/0303585 | A1 | 10/2017 | Florack et al. | |
| 2017/0318859 | A1 | 11/2017 | Batista | |
| 2018/0000165 | A1 | 1/2018 | Liu | |
| 2018/0014571 | A1 | 1/2018 | Nakano | |
| 2018/0070640 | A1 | 3/2018 | Bessant et al. | |
| 2018/0116280 | A1 | 5/2018 | Maiwald et al. | |
| 2018/0192707 | A1 | 7/2018 | Worm et al. | |
| 2018/0317560 | A1 | 11/2018 | Shinozaki et al. | |
| 2018/0325167 | A1 | 11/2018 | Grant | |
| 2018/0368468 | A1 | 12/2018 | Mishra et al. | |
| 2019/0000135 | A1 | 1/2019 | Lavanant et al. | |
| 2019/0000141 | A1 | 1/2019 | Rojo-Calderon et al. | |
| 2019/0000142 | A1 | 1/2019 | Lavanchy et al. | |
| 2019/0014818 | A1 | 1/2019 | Saygili | |
| 2019/0014820 | A1 | 1/2019 | Malgat | |
| 2019/0014821 | A1 | 1/2019 | Batista et al. | |
| 2019/0059449 | A1 | 2/2019 | Akiyama et al. | |
| 2019/0059450 | A1 | 2/2019 | Akiyama et al. | |
| 2019/0075848 | A1 | 3/2019 | Worm et al. | |
| 2019/0124972 | A1 | 5/2019 | Nakano | |
| 2019/0124973 | A1 | 5/2019 | Nakano et al. | |
| 2019/0133176 | A1 | 5/2019 | Nakano et al. | |
| 2019/0150505 | A1 | 5/2019 | Ceppi et al. | |
| 2019/0274358 | A1 | 9/2019 | Reevell | |
| 2020/0015519 | A1 | 1/2020 | Conner et al. | |
| 2020/0060333 | A1 | 2/2020 | Sutton et al. | |
| 2020/0146349 | A1 | 5/2020 | Phillips et al. | |
| 2020/0268044 | A1 | 8/2020 | Wilson | |
| 2021/0015172 | A1 | 1/2021 | Conner et al. | |
| 2021/0015174 | A1 | 1/2021 | Cox et al. | |
| 2021/0015175 | A1 | 1/2021 | Jackson et al. | |
| 2021/0337865 | A1 * | 11/2021 | Conner | A24F 40/40 |

FOREIGN PATENT DOCUMENTS

| | | |
|---|---|---|
| WO | WO1995034226 | 12/1995 |
| WO | WO1998054989 | 12/1998 |

(56) References Cited

FOREIGN PATENT DOCUMENTS

| | | | | |
|---|---|---|---|---|
| WO | WO2009022232 | | 2/2009 | |
| WO | WO2013072336 | | 5/2013 | |
| WO | WO2013083963 | | 6/2013 | |
| WO | WO2013149810 | | 10/2013 | |
| WO | WO2013189836 | | 12/2013 | |
| WO | WO2014037270 | | 3/2014 | |
| WO | WO2014156838 | | 10/2014 | |
| WO | WO2014180893 | | 11/2014 | |
| WO | WO2015097005 | | 7/2015 | |
| WO | WO2015128384 | | 9/2015 | |
| WO | WO2015151158 | | 10/2015 | |
| WO | WO2015184744 | | 12/2015 | |
| WO | WO2015197850 | | 12/2015 | |
| WO | WO2017042297 | | 3/2017 | |
| WO | WO2017108912 | | 6/2017 | |
| WO | WO2017114760 | | 7/2017 | |
| WO | WO2017115181 | | 7/2017 | |
| WO | WO2017115182 | | 7/2017 | |
| WO | WO-2017115182 | A1 * | 7/2017 | ..... A24F 13/02 |
| WO | WO2017115183 | | 7/2017 | |
| WO | WO2017115184 | | 7/2017 | |
| WO | WO-2017115184 | A1 * | 7/2017 | ..... A24F 13/02 |
| WO | WO2017115185 | | 7/2017 | |
| WO | WO2017115188 | | 7/2017 | |
| WO | WO2017115196 | | 7/2017 | |
| WO | WO-2017161442 | A1 * | 9/2017 | ..... A61P 37/08 |
| WO | WO2017207442 | | 12/2017 | |
| WO | WO2017212284 | | 12/2017 | |
| WO | WO2018170800 | | 9/2018 | |
| WO | WO2018201655 | | 11/2018 | |
| WO | WO2019010680 | | 1/2019 | |
| WO | WO2020216762 | | 10/2020 | |

* cited by examiner

AEROSOL DELIVERY DEVICE WITH DEFLECTABLE OR COLLAPSIBLE HOUSING

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable and/or replaceable components.

BRIEF SUMMARY

In various implementations, the present disclosure relates to aerosol delivery devices and holders for use with removable and replaceable cartridges. The present disclosure includes, without limitation, the following example implementations:

Example Implementation 1: A holder for use with a removable substrate cartridge, the holder comprising: a main body having a proximal end and a distal end and defining a use length in a use position, the main body further comprising: a receiving chamber configured to receive at least a portion of a removable substrate cartridge; an aerosol passageway that extends from the receiving chamber through the main body; and a collapsible section defined between the proximal end and distal end of the main body, wherein the collapsible section is configured to collapse in an axial direction into an ejecting position when an ejecting force is applied to one or both of the proximal end or the distal end of the main body, the main body further defining an ejecting length in the ejecting position, wherein the ejecting length is less than the use length, and wherein the collapsible portion is further configured to return to the use position when no ejecting force is applied to the main body.

Example Implementation 2: The holder of Example Implementation 1, or any combination of preceding example implementations, wherein the main body further comprises an internal receiving member that includes the receiving chamber.

Example Implementation 3: The holder of any one of Example Implementations 1-2, or any combination of preceding example implementations, wherein the main body further comprises a mouthend portion that includes the proximal end, a consumable end portion that includes the distal end, and an intermediate portion located between the mouthend portion and the consumable portion, and wherein the intermediate portion comprises the collapsible section.

Example Implementation 4: The holder of any one of Example Implementations 1-3, or any combination of preceding example implementations, wherein the main body further comprises a mouthend portion that includes the proximal end and a consumable portion that includes the distal end, and wherein the mouthend portion comprises the collapsible section.

Example Implementation 5: The holder of any one of Example Implementations 1-4, or any combination of preceding example implementations, wherein the main body further comprises a mouthend portion that includes the proximal end and a consumable portion that includes the distal end, and wherein the consumable portion comprises the collapsible section.

Example Implementation 6: The holder of any one of Example Implementations 1-5, or any combination of preceding example implementations, wherein the collapsible section forms at least one collapsed node in the ejecting position.

Example Implementation 7: The holder of any one of Example Implementations 1-6, or any combination of preceding example implementations, wherein the collapsible section forms a plurality of collapsed nodes in the ejecting position.

Example Implementation 8: The holder of any one of Example Implementations 1-7, or any combination of preceding example implementations, wherein the main body includes at least one stationary node and/or groove.

Example Implementation 9: The holder of any one of Example Implementations, 1-8, or any combination of preceding example implementations, wherein the main body further includes an internal plunger, and wherein when the ejecting force is applied to one or both of the proximal end or the distal end of the main body, the internal plunger is configured to eject a received removable substrate cartridge from the receiving chamber.

Example Implementation 10: The holder of any one of Example Implementations 1-9, or any combination of preceding example implementations, wherein the main body comprises a mouthend portion that includes the proximal end and a consumable portion that includes the distal end, and wherein the internal plunger is connected to the mouthend portion.

Example Implementation 11: A holder for use with a removable substrate cartridge, the holder comprising: a main body having a proximal end and a distal end, the main body comprising: a receiving chamber configured to receive at least a portion of a removable substrate cartridge; and at least one deflectable portion that includes the distal end of the main body, wherein the at least one deflectable portion forms at least a part of the receiving chamber when in a use position, wherein the at least one deflectable portion is configured to rotate relative to the remaining main body into an ejecting position when at least one ejecting force is applied to the main body, and wherein the at least one deflectable portion is further configured to return to the use position when no ejecting force is applied to the main body.

Example Implementation 12: The holder of Example Implementation 11, or any combination of preceding example implementations, wherein the at least one deflectable portion comprises a single deflectable portion, wherein the single deflectable portion defines a pivot axis, an inward rotating side, and an outward rotating side, wherein the inward rotating side is located on one side of the pivot axis, and the outward rotating side is located on an opposite side of the pivot axis, and wherein the at least one ejecting force is applied to the inward rotating side of the single deflectable portion to rotate the single deflectable portion into the ejecting position.

Example Implementation 13: The holder of any one of Example Implementations 11-12, or any combination of preceding example implementations, wherein the at least one deflectable portion comprises a pair of opposing deflectable portions, wherein the pair of deflectable portions define a pivot axis, and respective inward rotating sides, and outward rotating sides, wherein the inward rotating sides are located on one side of the pivot axis, and the outward rotating sides are located on an opposite side of the pivot axis, and wherein the at least one ejecting force comprises respective ejecting forces applied to the inward rotating sides of the pair of deflectable portions to rotate the pair of deflectable portions into the ejecting position.

Example Implementation 14: The holder of any one of Example Implementations 11-13, or any combination of preceding example implementations, wherein the respective ejecting forces are applied substantially simultaneously to the inward rotating sides.

Example Implementation 15: The holder of any one of Example Implementations 11-14, or any combination of preceding example implementations, wherein the main body defines a longitudinal axis, and wherein the at least one ejecting force is applied substantially perpendicular to the longitudinal axis.

Example Implementation 16: The holder of any one of Example Implementations 11-15, or any combination of preceding example implementations, further comprising an internal return spring, and wherein the internal returns spring is configured to return the at least one deflectable portion to the use position when no ejecting force is applied to the main body.

Example Implementations 17: The holder of any one of Example implementations 11-16, or any combination of preceding example implementations, wherein the material of the at least one deflectable portion is configured to return the at least one deflectable portion to the use position when no ejecting force is applied to the main body.

Example Implementation 18: The holder of any one of Example Implementations 11-17, or any combination of preceding example implementations, wherein the main body has a substantially cylindrical shape when in the use position.

Example Implementation 19: The holder of any one of Example Implementations 11-18, or any combination of preceding example implementations, wherein the main body has a substantially hourglass shape when in the use position.

Example Implementation 20: The holder of any one of Example Implementations 11-19, or any combination of preceding example implementations, wherein the at least one deflectable portion is made of a different material than the remaining main body.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
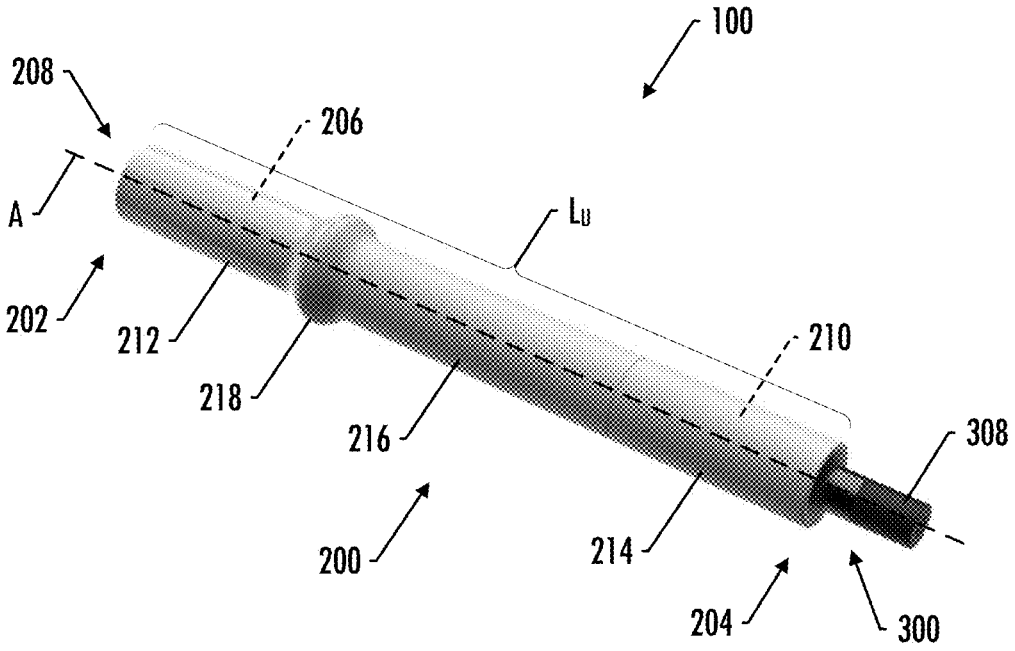
Figure 2:
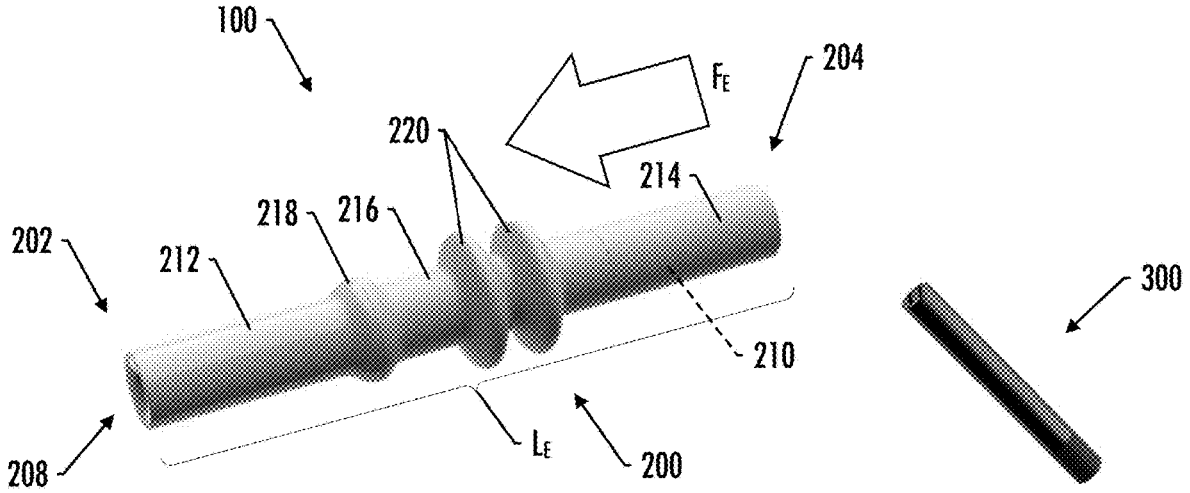
Figure 3:
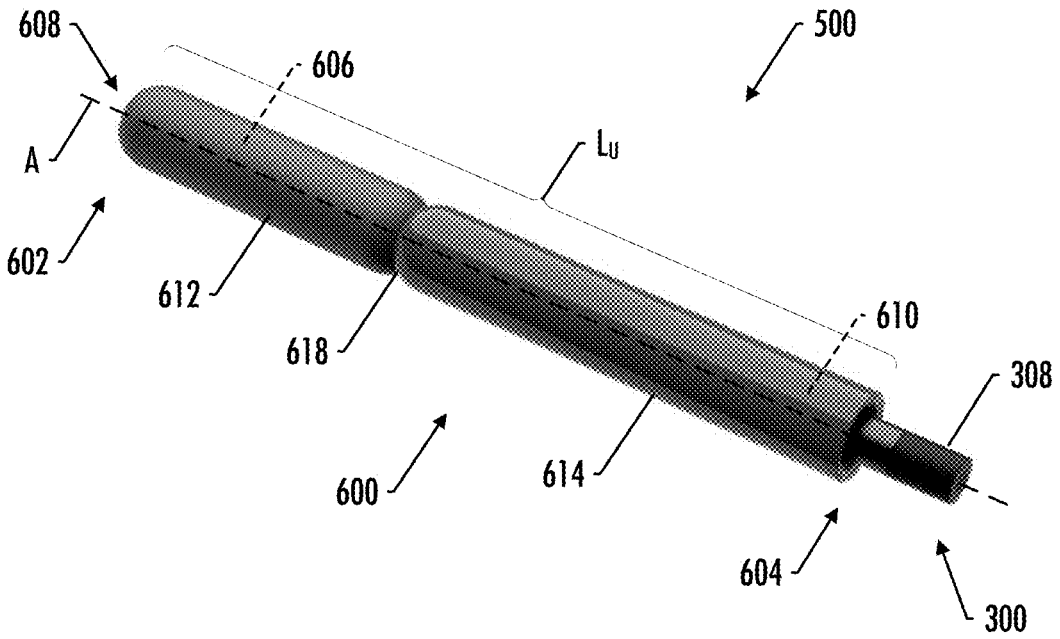
Figure 4:
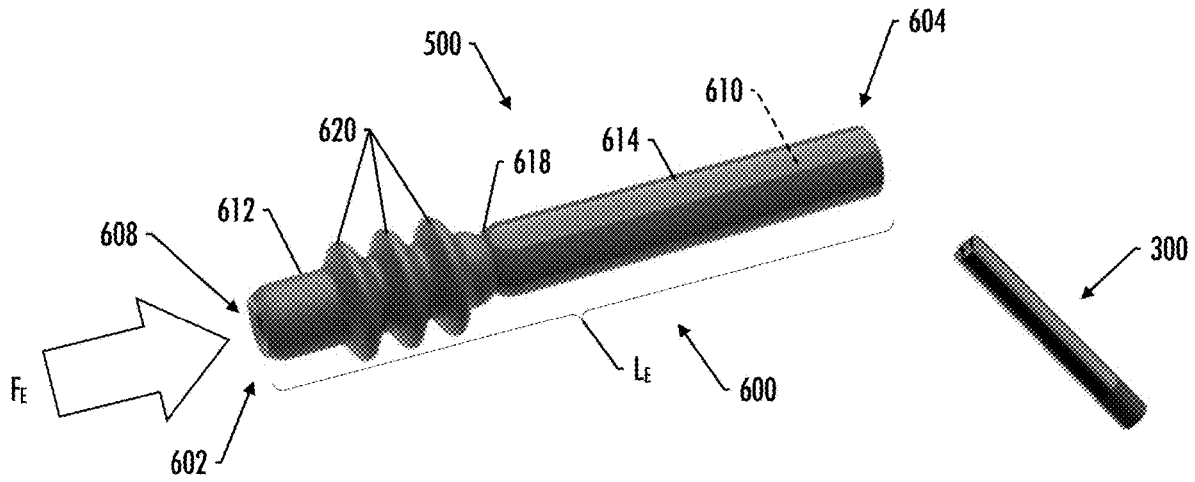
Figure 5:
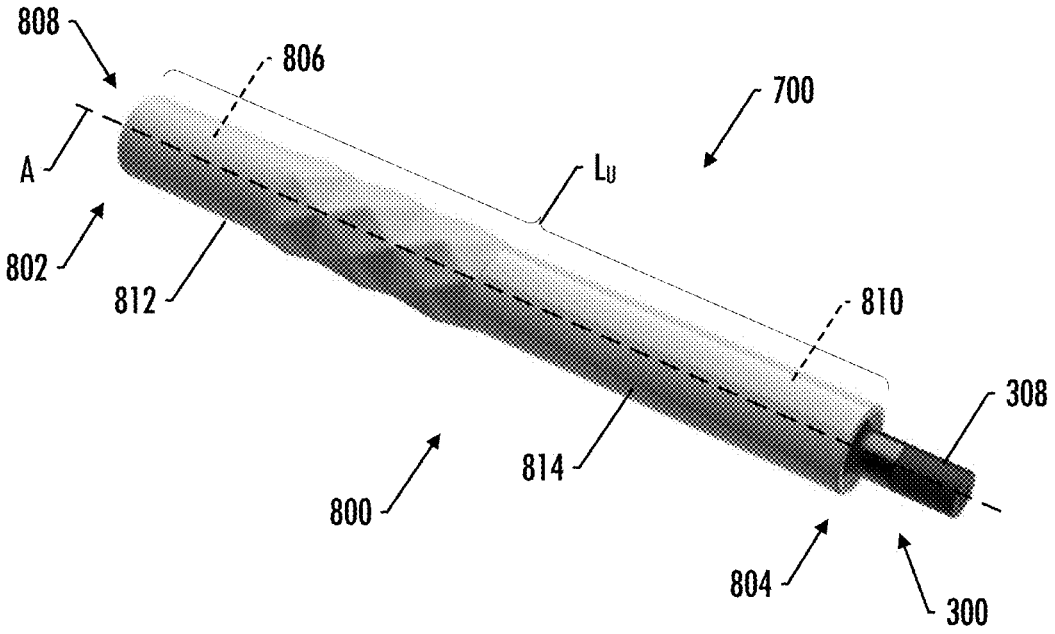
Figure 6:
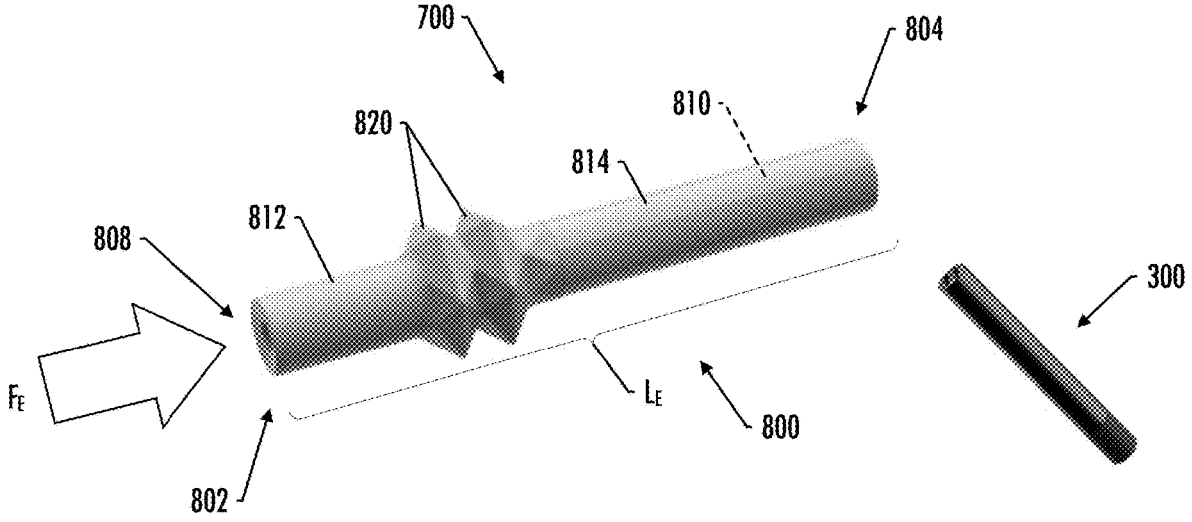
Figure 7:
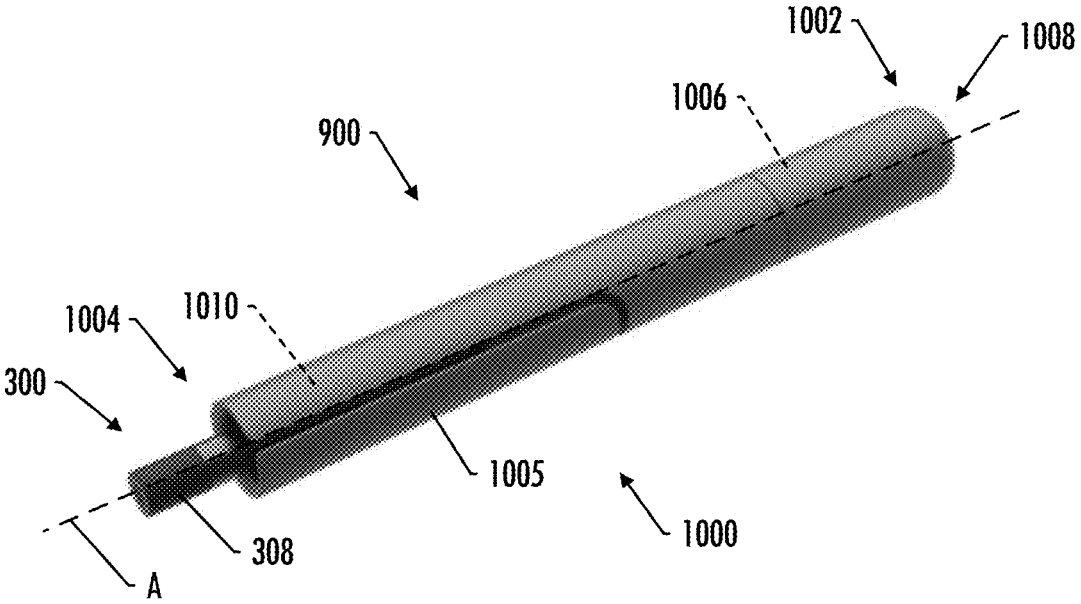
Figure 8:
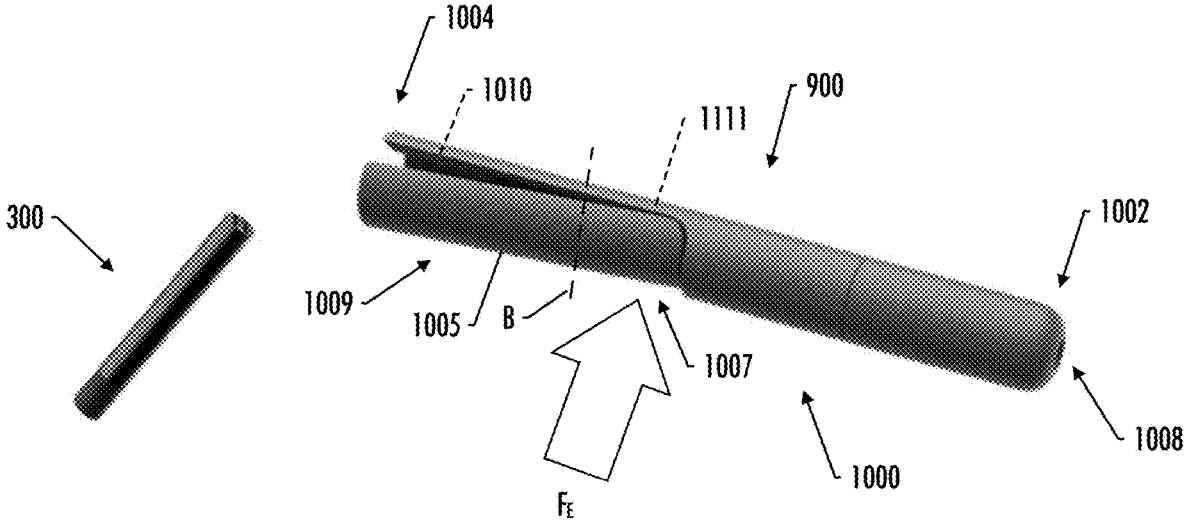
Figure 9:
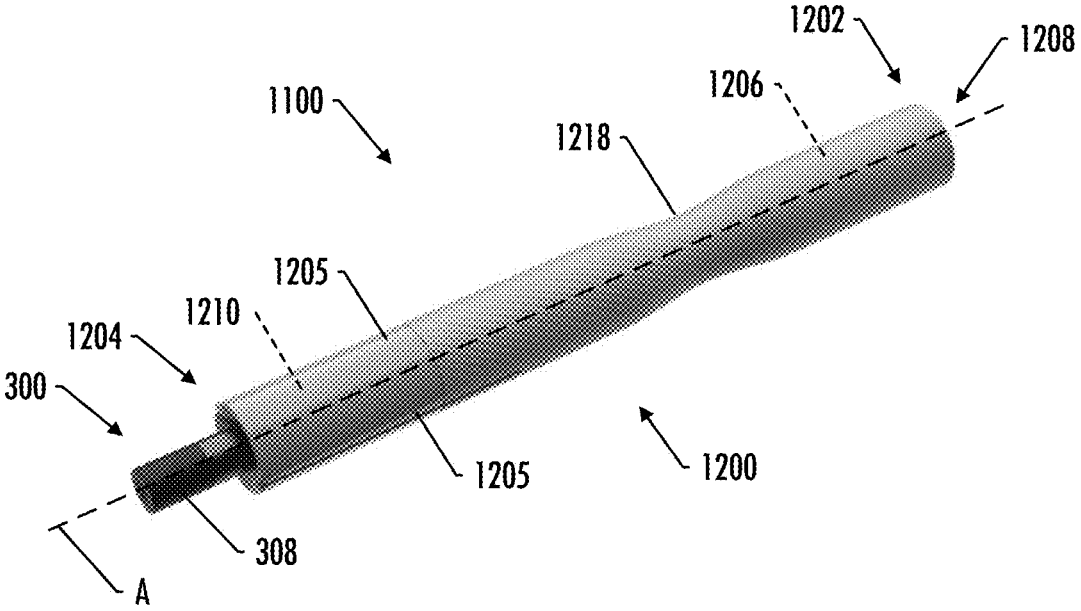
Figure 10:
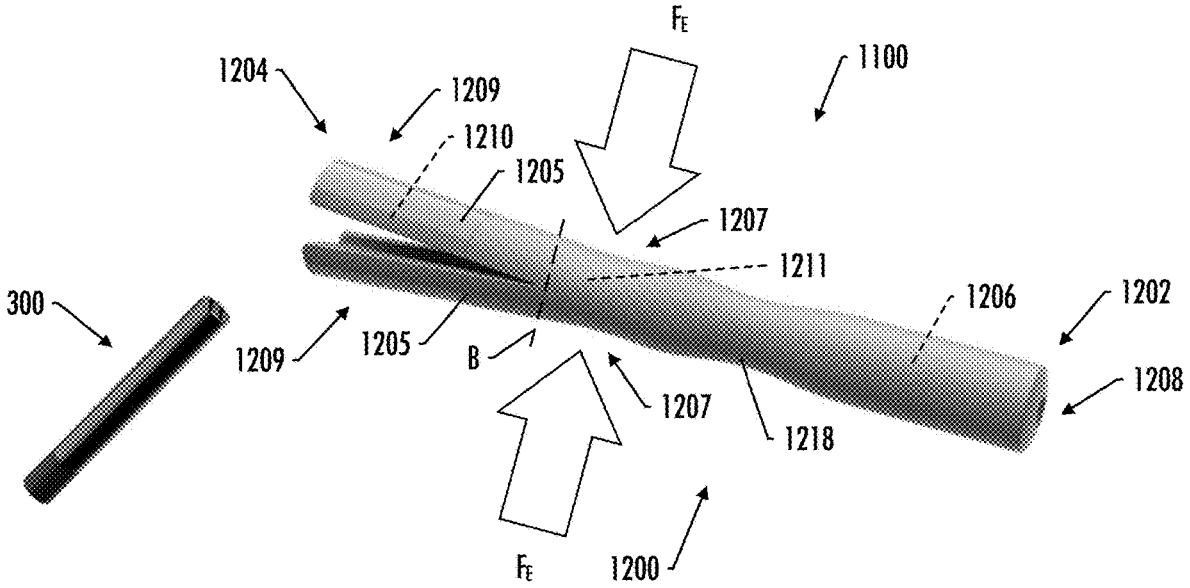
Figure 11:
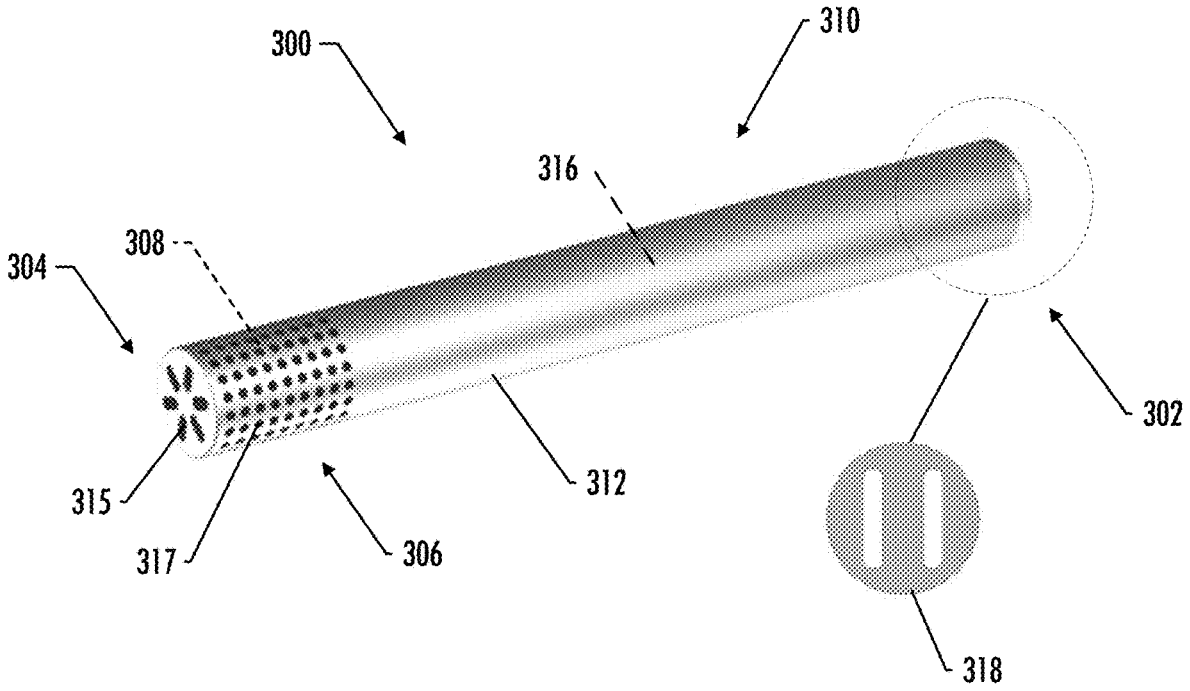
Figure 12:
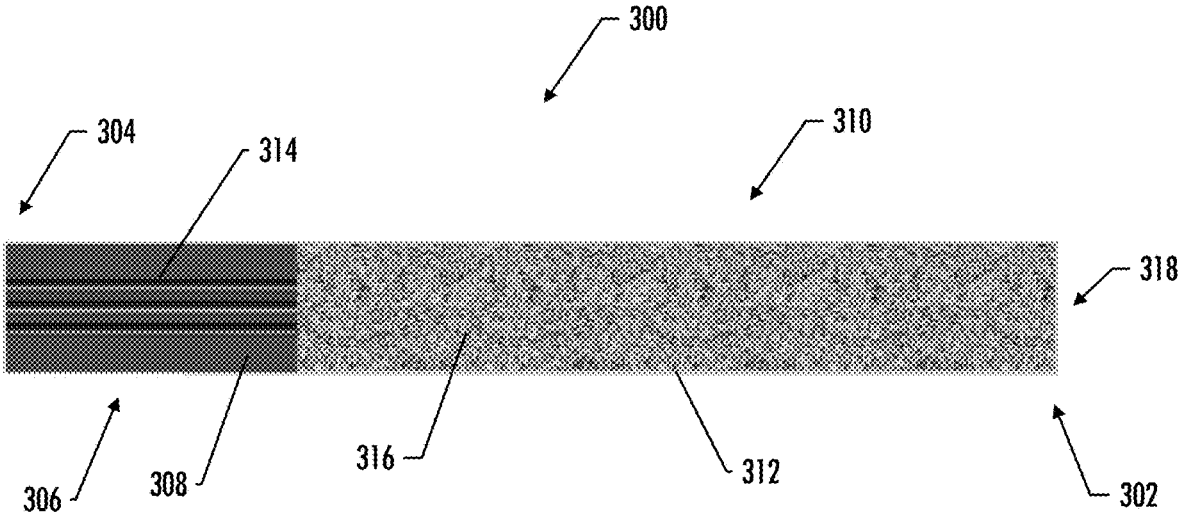
Figure 13:
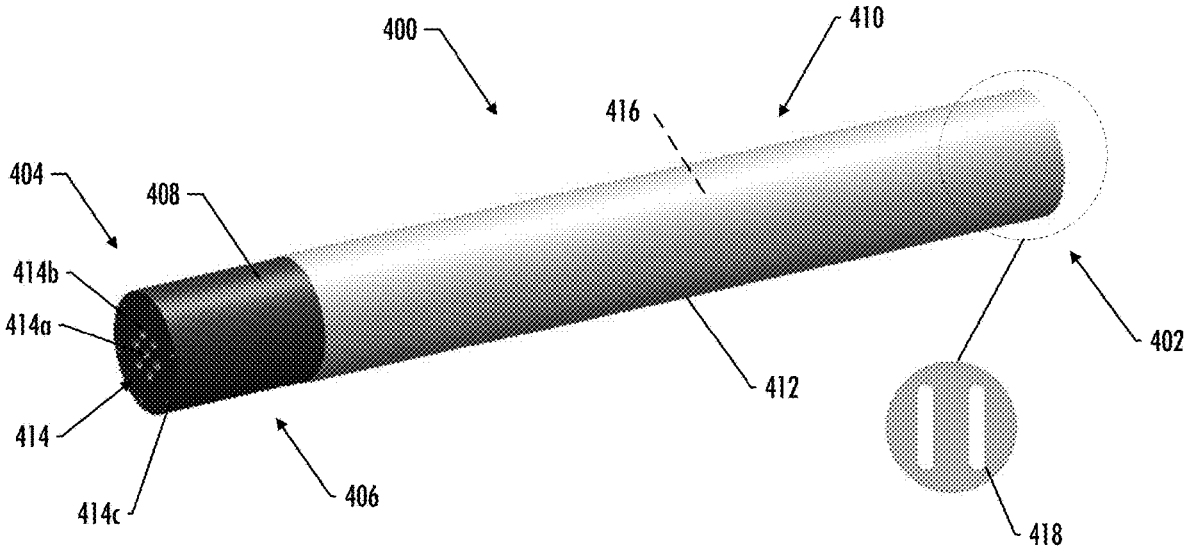
Figure 14:
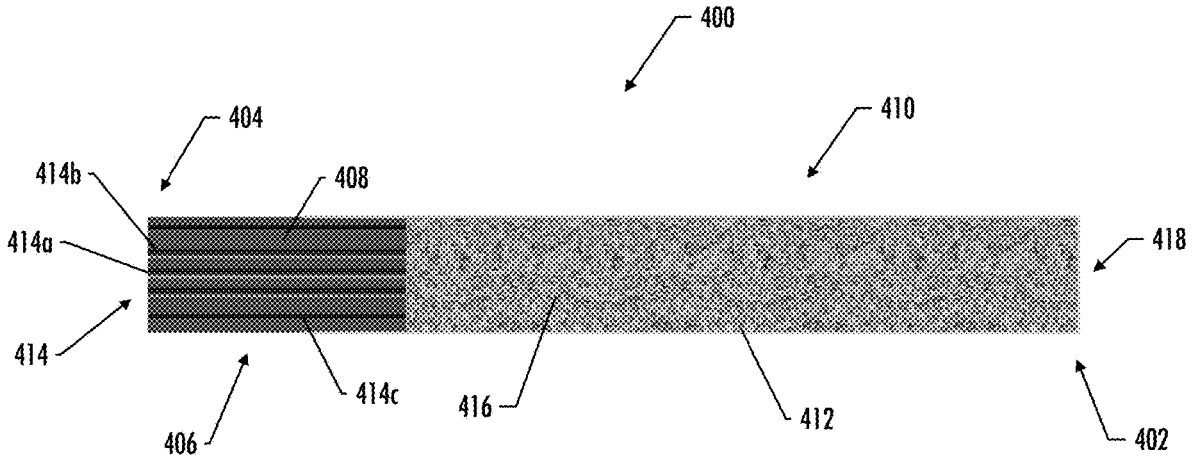

Having thus described the disclosure in the foregoing general terms, reference will now be made to the accompanying drawings, which are not necessarily drawn to scale, and wherein:

FIG. 1 illustrates perspective view of a holder configured for use with a removable cartridge shown in a use position, according to one example implementation of the present disclosure;

FIG. 2 illustrates a perspective view of a holder configured for use with a removable cartridge shown in an ejecting position, according to one example implementation of the present disclosure;

FIG. 3 illustrates a perspective view of a holder configured for use with a removable cartridge shown in a use position, according to one example implementation of the present disclosure;

FIG. 4 illustrates a perspective view of a holder configured for use with a removable cartridge shown in an ejecting position, according to one example implementation of the present disclosure;

FIG. 5 illustrates a perspective view of a holder configured for use with a removable cartridge shown in a use position, according to one example implementation of the present disclosure;

FIG. 6 illustrates a perspective view of a holder configured for use with a removable cartridge shown in an ejecting position, according to one example implementation of the present disclosure;

FIG. 7 illustrates a perspective view of a holder configured for use with a removable cartridge shown in a use position, according to one example implementation of the present disclosure;

FIG. 8 illustrates a perspective view of a holder configured for use with a removable cartridge shown in an ejecting position, according to one example implementation of the present disclosure;

FIG. 9 illustrates a perspective view of a holder configured for use with a removable cartridge shown in a use position, according to one example implementation of the present disclosure;

FIG. 10 illustrates a perspective view of a holder configured for use with a removable cartridge shown in an ejecting position, according to one example implementation of the present disclosure;

FIG. 11 illustrates a perspective view of a removable cartridge, according to one example implementation of the present disclosure;

FIG. 12 illustrates a longitudinal cross-section view of a removable cartridge, according to one example implementation of the present disclosure;

FIG. 13 illustrates a perspective view of a removable cartridge, according to one example implementation of the present disclosure; and FIG. 14 illustrates a longitudinal cross-section view of a removable cartridge, according to one example implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some aspects, articles or devices characterized as smoking articles incorporate tobacco and/or components derived from tobacco.

As noted, aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that device much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. In some example implementations, an elongated body resembling the shape of a cigarette or cigar can be formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In another example, an aerosol delivery device may be substantially rectangular or have a substantially rectangular cuboid shape. In one example, all of the components of the aerosol delivery device are contained within one housing. Alternatively, an aerosol delivery device can comprise two or more housings that are joined and are separable. For example, an aerosol delivery device can possess one portion comprising a housing containing one or more reusable components (e.g., an accumulator such as a rechargeable battery and/or rechargeable supercapacitor, and various electronics for controlling the operation of that article), and removably coupleable thereto, another second portion (e.g., a mouthpiece) and/or a disposable component (e.g., a disposable flavor-containing cartridge containing aerosol precursor material, flavorant, etc.). More specific formats, configurations and arrangements of components within the single housing type of unit or within a multi-piece separable housing type of unit will be evident in light of the further disclosure provided herein. Additionally, various aerosol delivery device designs and component arrangements can be appreciated upon consideration of the commercially available electronic aerosol delivery devices.

In various aspects, the heat source of a cartridge may be capable of generating heat to aerosolize a substrate material of the cartridge that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. As will be described in more detail below, in some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

According to certain aspects of the present disclosure, it may be advantageous to provide an aerosol delivery device that is easy to use and that provides reusable and/or replaceable components. FIG. 1 illustrates one example implementation of such a device comprising a holder 100 for use with a removable substrate cartridge (described in more detail below with respect to FIGS. 11-14). In the depicted implementation, the holder 100 includes a main body 200 substantially aligned with axis A and that defines a proximal end 202 and a distal end 204. The holder 100 also includes an internal aerosol passageway 206 that extends from an opening 208 at the proximal end 202 of the main body 200 to a receiving chamber 210 configured to receive a portion of the consumable substrate cartridge 300. The internal passageway 206 allows aerosol from an ignited cartridge to travel through the main body 200 and through the opening 208 for delivery to a user. The depicted implementation further includes a mouthend portion 212, which includes the proximal end 202, and a consumable portion 214, which includes the distal end 204. The main body 200 of the depicted implementation further includes an intermediate portion 216 located between the mouthend portion 212 and the consumable portion 214. In the depicted implementation, the receiving chamber 210 is part of the consumable portion 214; however, in other implementations, the receiving chamber may be part of a separate internal receiving member. In still other implementations, the receiving chamber may span one or more portions of the holder.

In the depicted implementation, the holder 100 includes one or more features configured to retain or temporarily "lock" the cartridge 300 in place within the holder 100 when the cartridge 300 is inserted into the receiving chamber 210. In the depicted implementation, the receiving chamber 210 includes an elastomeric protuberance or ring (not shown) that extends radially inwardly and is configured to frictionally and/or sealingly engage an outer surface of the removable cartridge 300. In some implementations, the elastomeric protuberance or ring may be part of a sleeve that may be integral with the receiving chamber, such as, for example, as part of an over-molded part. In other implementations, other retaining features may be used. For example, in some implementations one or more retention spheres may form part of a cartridge retention assembly. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets. Combinations of two or more of these retaining features may also be used.

The holder 100 of the depicted implementation is shown in FIG. 1 in a use position, in which an inserted cartridge 300 may deliver aerosol to a user. In the depicted implementation, the use position also comprises a lighting position in which the heat source 308 of the cartridge 300 may be ignited (e.g., using a lighter or match). In other implementation, the lighting position may be different from the use position. In the use position of the depicted implementation, less than half of the length of the inserted cartridge 300 extends beyond (e.g., outside of) the distal end 204 of the main body 200. In particular, in the use position of the depicted implementation, the heat source 308 of an inserted cartridge 300 extends fully beyond (e.g., outside of) the distal end 204 of the holder 100, while a majority of the remaining portion of the cartridge is located within (e.g., toward the proximal end 202 of) the main body 200. It should be noted that in other implementations, an inserted cartridge may have other configurations in a use position. For example, in the use position of some implementations, a majority of the length of an inserted cartridge may be located inside of the main body such that only a portion of the heat source of the cartridge extends outside of the main body. In the use position of other implementations, an inserted cartridge may be fully positioned within holder, such that no portion of the cartridge extends beyond the distal end of the main body. For example, in some of such implementations, a distal end of the inserted cartridge may substantially align with the distal end of the main body, or the distal end an inserted cartridge may be positioned closer to the proximal end of the main body than the distal end of the main body. In the use position of other implementations, an inserted cartridge may extend approximately halfway inside and halfway outside of the main body (e.g., the distal end of the main body may be proximate a location of an inserted cartridge that is the midpoint of the cartridge). In the use position of still other implementations, a majority (e.g., more than half) of the length of an inserted cartridge may extend beyond (e.g., outside of) the main body.

The holder of various implementations is configured to be held by a user. In the depicted implementation, the holder has a substantially cylindrical outer shape having a substantially circular cross-section. In other implementations, the holder may have any shape configured for handheld use. For example, the holder, or a portion thereof, of some implementations may have a non-cylindrical outer shape, such as, for example, a shape having a substantially oval or substantially oblong cross-section. In other implementations, the holder, or a portion thereof, may have an outer shape with a substantially rectangular or substantially square cross-section. In still other implementations, the holder, or a portion thereof, may have an outer shape with other polygonal cross-sections.

In some implementations, the holder may include additional features configured to aid in the handling and/or holding of the device. In the depicted implementation, for example, the holder 100 includes a single stationary node 218 configured to rest against a user's finger or fingers while the user is using the device. In the depicted implementation, the stationary node 218 comprises a discrete, localized area of increased outer diameter that includes a smooth transition from the outer diameter of the portions of the main body 200 on either side thereof. In other implementations, a stationary node may have any shape of increased size relative to other portions of the holder. In the depicted implementation, the center of the stationary node 218 comprises the delineation between the mouthend portion 212 and the intermediate portion 216 of the main body 200; however, in other implementations, a stationary node may have any other location along the length of the holder. Still other implementations need not include a stationary node. In other implementations, rather than a stationary node (or in addition to a stationary node), the holder may include one or more discrete, localized areas of decreased outer diameter (e.g., grooves and/or depressions) located at any location along the length of the holder. Still other implementations need not include any areas of decreased outer diameter. In the depicted implementation, aside from the stationary node 218, the remaining surface of the intermediate portion is substantially smooth in the use position.

In the depicted implementation, the holder 100 is also configured to have an ejecting position in which the cartridge 300 is ejected from the receiving chamber 210 of the main body 200. FIG. 2 illustrates the ejecting position of the holder 100 of FIG. 1. In the depicted implementation, holder 100 is configured to collapse in the axial direction into the ejecting position. More particularly, the holder 100 of the depicted implementation includes a collapsible section that is configured to collapse in an axial direction (e.g., generally along axis A) into the ejecting position when an ejecting force is applied to the holder 100. In the depicted implementation, at least a portion of the intermediate portion 216 comprises the collapsible section; however, in other implementations, the collapsible section may comprise various other locations along the length of a holder.

Upon an ejecting force $F_E$ applied to the main body 200, the intermediate portion 216 of the depicted implementation is configured to collapse such that the distal end 204 of the main body 200 moves toward the proximal end 202. In such a manner, in the ejecting position of the depicted implementation, the main body 200 defines an ejecting length $L_E$ that is less than a length of the holder 100 in the use position $L_U$ (compare FIG. 2 to FIG. 1, which illustrates the use length $L_U$ of the holder 100). When the holder 100 of the depicted implementation is in the ejecting position, the intermediate portion 216 forms one or more collapsed nodes 220 at certain locations along the intermediate portion 216. Although in various implementations any number of collapsed nodes may be possible, including, for example, as few as one, in the depicted implementation two collapsed nodes 220 are formed.

In the depicted implementation, the mouthend portion 212 of the main body 200 also includes an internal plunger (not shown) that, in the use position, is either in contact with, or separated a distance from, a proximal end (e.g., the end opposite the heat source end) of the cartridge 300. When the distal end 204 of the main body 200 of the depicted implementation moves toward the proximal end 202 of the main body 200, the consumable portion 214 of the main body 200 moves toward the mouthend portion 212, taking with it the receiving chamber 210 and the cartridge 300 retained therein. As such, as the ejection force $F_E$ is applied to the consumable portion 214 of the main body 200, the inserted cartridge 300 moves toward the internal plunger, which presses against the proximal end of the cartridge 300 until the retaining features of the receiving chamber 210 no longer capture the cartridge 300, thus ejecting the cartridge 300 from the main body 200.

When no ejecting force $F_E$ is applied to the main body 200 of the depicted implementation (such as, for example, once the cartridge 300 has been ejected), the intermediate portion 216 is configured to return to the use position. In particular, when no ejecting force $F_E$ is applied to the main body 200 of the depicted implementation, the collapsed nodes 220 recede and/or straighten and the holder 100 assumes the use length $L_U$. In the depicted implementation, the intermediate portion 216 is made of an elastomeric polymer material configured to return to its original shape in the absence of force. In other implementations, the intermediate portion may be made of other materials, including, for example, one or more metal materials, and/or composite materials. In some implementations, the holder may include one or more internal features (such as, for example, one or more spring features) that may cause, or assist, in returning the main body to the use position.

In various implementations, the holder, or any components thereof, may be made of a moldable plastic material such as, for example, polycarbonate, polyethylene, acrylonitrile butadiene styrene (ABS), polyamide (Nylon), or polypropylene. In other implementations, the holder, or any of its components, may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, a fabric material, or any combinations thereof. In the depicted implementation, the holder is made of a combination of materials. For example, in the depicted implementation, the mouthend portion 212 and the consumable portion 214 are made of a moldable plastic material that is different than the material of the intermediate portion 216. In other implementations, any two, or all three of the mouthend portion, the intermediate portion, and the consumable portion may be made of the same material. In still other implementations, each of the mouthend portion, the intermediate portion, and the consumable portion may be made of a different material. In some implementations, the colors of the various components of the holder may be the same. In other implementations, the colors of one or more of the components may differ from the colors of the other components. For example, in some implementations, the consumable portion may be one color, and intermediate portion and mouthend portions may be another color, which, in some implementations, may contrast with the color of the consumable portion. In other implementations, the intermediate portion may be one color, and the mouthend and consumable portions may be another color.

FIG. 3 illustrates another example implementation of a holder 500 for use with a removable substrate cartridge 300. In the depicted implementation, the holder 500 includes a main body 600 substantially aligned with axis A and that defines a proximal end 602 and a distal end 604. The holder 600 also includes an internal aerosol passageway 606 that extends from an opening 608 at the proximal end 602 of the main body 600 to a receiving chamber 610 configured to receive a portion of the consumable substrate cartridge 300. The internal passageway 606 allows aerosol from an ignited cartridge to travel through the main body 600 and through the opening 608 for delivery to a user. The depicted implementation further includes a mouthend portion 612, which includes the proximal end 602, and a consumable portion 614, which includes the distal end 604. In the depicted implementation, the receiving chamber 610 is part of the consumable portion 614; however, in other implementations, the receiving chamber may be part of a separate internal receiving member. In still other implementations, the receiving chamber may span one or more portions of the holder.

In the depicted implementation, the holder 500 includes one or more features configured to retain or temporarily "lock" the cartridge 300 in place within the holder 500 when the cartridge 300 is inserted into the receiving chamber 610. In the depicted implementation, the receiving chamber 610 includes an elastomeric protuberance or ring (not shown) that extends radially inwardly and is configured to frictionally and/or sealingly engage an outer surface of the removable cartridge 300. In some implementations, the elastomeric protuberance or ring may be part of a sleeve that may be integral with the receiving chamber, such as, for example, as part of an over-molded part. In other implementations, other retaining features may be used. For example, in some implementations one or more retention spheres may form part of a cartridge retention assembly. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets. Combinations of two or more of these retaining features may also be used.

The holder 500 of the depicted implementation is shown in FIG. 3 in a use position, in which an inserted cartridge 300 may deliver aerosol to a user. In the depicted implementation, the use position also comprises a lighting position in which the heat source 308 of the cartridge 300 may be ignited (e.g., using a lighter or match). In other implementation, the lighting position may be different from the use position. In the use position of the depicted implementation, less than half of the length of the inserted cartridge 300 extends beyond (e.g., outside of) the distal end 604 of the main body 600. In particular, in the use position of the depicted implementation, the heat source 308 of an inserted cartridge 300 extends fully beyond (e.g., outside of) the distal end 604 of the holder 500, while a majority of the remaining portion of the cartridge is located within (e.g., toward the proximal end 602 of) the main body 600. It should be noted that in other implementations, an inserted cartridge may have other configurations in a use position. For example, in the use position of some implementations, a majority of the length of an inserted cartridge may be located inside of the main body such that only a portion of the heat source of the cartridge extends outside of the main body. In the use position of other implementations, an inserted cartridge may be fully positioned within holder, such that no portion of the cartridge extends beyond the distal end of the main body. For example, in some of such implementations, a distal end of the inserted cartridge may substantially align with the distal end of the main body, or the distal end an inserted cartridge may be positioned closer to the proximal end of the main body than the distal end of the main body. In the use position of other implementations, an inserted cartridge may extend approximately halfway inside and halfway outside of the main body (e.g., the distal end of the main body may be proximate a location of an inserted cartridge that is the midpoint of the cartridge). In the use position of still other implementations, a majority (e.g., more than half) of the length of an inserted cartridge may extend beyond (e.g., outside of) the main body.

The holder of various implementations is configured to be held by a user. In the depicted implementation, the holder has a substantially cylindrical outer shape having a substantially circular cross-section. In other implementations, the holder may have any shape configured for handheld use. For example, the holder, or a portion thereof, of some implementations may have a non-cylindrical outer shape, such as, for example, a shape having a substantially oval or substantially oblong cross-section. In other implementations, the holder, or a portion thereof, may have an outer shape with a substantially rectangular or substantially square cross-section. In still other implementations, the holder, or a portion thereof, may have an outer shape with other polygonal cross-sections.

In some implementations, the holder may include additional features configured to aid in the handling and/or holding of the device. In the depicted implementation, for example, the holder 100 includes a groove 618 configured for placement of a user's finger or fingers while using the device. In the depicted implementation, the groove 618 comprises a discrete, localized area of decreased outer diameter that includes a smooth transition from the outer diameter of the portions of the main body 500 on either side thereof. In other implementations, other features configured for assisting a user with holding and using the device may be included, alternatively or additionally. In the depicted implementation, the center of the groove 618 comprises the delineation between the mouthend portion 612 and the intermediate portion 616 of the main body 500; however, in other implementations, a groove may have any other location along the length of the holder. Still other implementations need not include a groove. In other implementations, rather than a groove (or in addition to a groove), the holder may include one or more discrete, localized areas of increased outer diameter (e.g., nodes) or other discrete, localized areas of decreased diameter (e.g., depressions) located at any location along the length of the holder. Still other implementations need not include any areas of increased outer diameter. In the depicted implementation, aside from the groove 618, the remaining surface of the mouthend portion is substantially smooth in the use position.

In the depicted implementation, the holder 500 is also configured to have an ejecting position in which the cartridge 300 is ejected from the receiving chamber 610 of the main body 200. FIG. 4 illustrates the ejecting position of the holder 500 of FIG. 3. In the depicted implementation, holder 500 is configured to collapse in the axial direction into the ejecting position. More particularly, the holder 500 of the depicted implementation includes a collapsible section that is configured to collapse in an axial direction (e.g., generally along axis A) into the ejecting position when an ejecting force is applied to the holder 500. In the depicted implementation, at least a portion of the mouthend portion 612 comprises the collapsible section; however, in other implementations, the collapsible section may comprise various other locations along the length of a holder.

Upon an ejecting force $F_E$ applied to the main body 600, the mouthend portion 612 of the depicted implementation is configured to collapse such that the proximal end 602 of the main body 600 moves toward the distal end 604. In such a manner, in the ejecting position of the depicted implementation, the main body 600 defines an ejecting length $L_E$ that is less than a length of the holder 500 in the use position $L_U$ (compare FIG. 4 to FIG. 3, which illustrates the use length $L_U$ of the holder 500). When the holder 500 of the depicted implementation is in the ejecting position, the mouthend portion 612 forms one or more collapsed nodes 620 at certain locations along the mouthend portion 612. Although in various implementations any number of collapsed nodes may be possible, including, for example, as few as one, in the depicted implementation three collapsed nodes 620 are formed.

In the depicted implementation, the mouthend portion 612 of the main body 600 also includes an internal plunger (not shown) that, in the use position, is either in contact with, or separated a distance from, a proximal end (e.g., the end opposite the heat source end) of the cartridge 300. When the proximal end 602 of the main body 600 of the depicted implementation moves toward the distal end 604 of the main body, the plunger presses against the proximal end of the cartridge 300 until the retaining features of the receiving chamber 610 no longer capture the cartridge 300, thus ejecting the cartridge 300 from the main body 600.

When no ejecting force $F_E$ is applied to the main body 600 of the depicted implementation (such as, for example, once the cartridge 300 has been ejected), the mouthend portion 612 is configured to return to the use position. In particular, when no ejecting force $F_E$ is applied to the main body 600 of the depicted implementation, the collapsed nodes 620 recede and/or straighten and the holder 500 assumes the use length $L_U$. In the depicted implementation, the mouthend portion 612 is made of an elastomeric polymer material configured to return to its original shape in the absence of force. In other implementations, the mouthend portion may be made of other materials, including, for example, one or more metal materials, and/or composite materials. In some implementations, the holder may include one or more internal features (such as, for example, one or more spring features) that may cause, or assist, in returning the main body to the use position.

In various implementations, the holder, or any components thereof, may be made of a moldable plastic material such as, for example, polycarbonate, polyethylene, acrylonitrile butadiene styrene (ABS), polyamide (Nylon), or polypropylene. In other implementations, the holder, or any of its components, may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, a fabric material, or any combinations thereof. In the depicted implementation, the holder is made of a combination of materials. For example, in the depicted implementation, the mouthend portion 612 is made of a moldable plastic material that is different than the material of the consumable portion 614. In other implementations, the mouthend portion and the consumable portion may be made of the same material. In some implementations, the colors of the various components of the holder may be the same. In other implementations, the colors of one or more of the components may differ from the colors of the other components. For example, in some implementations, the consumable portion may be one color, and the mouthend portion may be another color, which, in some implementations, may contrast with the color of the consumable portion.

FIG. 5 illustrates another example implementation of a holder 700 for use with a removable substrate cartridge 300. In the depicted implementation, the holder 700 includes a main body 800 substantially aligned with axis A and that defines a proximal end 802 and a distal end 804. The holder 800 also includes an internal aerosol passageway 806 that extends from an opening 808 at the proximal end 802 of the main body 800 to a receiving chamber 810 configured to receive a portion of the consumable substrate cartridge 300. The internal passageway 806 allows aerosol from an ignited cartridge to travel through the main body 800 and through the opening 808 for delivery to a user. The depicted implementation further includes a mouthend portion 812, which includes the proximal end 802, and a consumable portion 814, which includes the distal end 804. In the depicted implementation, the receiving chamber 810 is part of the consumable portion 814; however, in other implementations, the receiving chamber may be part of a separate internal receiving member. In still other implementations, the receiving chamber may span one or more portions of the holder.

In the depicted implementation, the holder 700 includes one or more features configured to retain or temporarily "lock" the cartridge 300 in place within the holder 700 when the cartridge 300 is inserted into the receiving chamber 810. In the depicted implementation, the receiving chamber 810 includes an elastomeric protuberance or ring (not shown) that extends radially inwardly and is configured to frictionally and/or sealingly engage an outer surface of the removable cartridge 300. In some implementations, the elastomeric protuberance or ring may be part of a sleeve that may be integral with the receiving chamber, such as, for example, as part of an over-molded part. In other implementations, other retaining features may be used. For example, in some implementations one or more retention spheres may form part of a cartridge retention assembly. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets. Combinations of two or more of these retaining features may also be used.

The holder 700 of the depicted implementation is shown in FIG. 5 in a use position, in which an inserted cartridge 300 may deliver aerosol to a user. In the depicted implementation, the use position also comprises a lighting position in which the heat source 308 of the cartridge 300 may be ignited (e.g., using a lighter or match). In other implementation, the lighting position may be different from the use position. In the use position of the depicted implementation, less than half of the length of the inserted cartridge 300 extends beyond (e.g., outside of) the distal end 804 of the main body 800. In particular, in the use position of the depicted implementation, the heat source 308 of an inserted cartridge 300 extends fully beyond (e.g., outside of) the distal end 804 of the holder 700, while a majority of the remaining portion of the cartridge is located within (e.g., toward the proximal end 802 of) the main body 800. It should be noted that in other implementations, an inserted cartridge may have other configurations in a use position. For example, in the use position of some implementations, a majority of the length of an inserted cartridge may be located inside of the main body such that only a portion of the heat source of the cartridge extends outside of the main body. In the use position of other implementations, an inserted cartridge may be fully positioned within holder, such that no portion of the cartridge extends beyond the distal end of the main body. For example, in some of such implementations, a distal end of the inserted cartridge may substantially align with the distal end of the main body, or the distal end an inserted cartridge may be positioned closer to the proximal end of the main body than the distal end of the main body. In the use position of other implementations, an inserted cartridge may extend approximately halfway inside and halfway outside of the main body (e.g., the distal end of the main body may be proximate a location of an inserted cartridge that is the midpoint of the cartridge). In the use position of still other implementations, a majority (e.g., more than half) of the length of an inserted cartridge may extend beyond (e.g., outside of) the main body.

The holder of various implementations is configured to be held by a user. In the depicted implementation, the holder has a substantially cylindrical outer shape having a substantially circular cross-section for a portion of the mouthend portion 812 and the consumable portion 814. In other implementations, the holder may have any shape configured for handheld use. For example, the holder, or a portion thereof, of some implementations may have a non-cylindrical outer shape, such as, for example, a shape having a substantially oval or substantially oblong cross-section. In other implementations, the holder, or a portion thereof, may have an outer shape with a substantially rectangular or substantially square cross-section. In still other implementations, the holder, or a portion thereof, may have an outer shape with other polygonal cross-sections.

In some implementations, the holder may include additional features configured to aid in the handling and/or holding of the device. For example, the holder may include one or more grooves, nodes, depressions, etc. configured for placement of a user's finger or fingers while using the device. Still other implementations need not include a holding feature.

In the depicted implementation, the holder 700 is also configured to have an ejecting position in which the cartridge 300 is ejected from the receiving chamber 810 of the main body 800. FIG. 6 illustrates the ejecting position of the holder 700 of FIG. 5. In the depicted implementation, holder 700 is configured to collapse in the axial direction into the ejecting position. More particularly, the holder 700 of the depicted implementation includes a collapsible section that is configured to collapse in an axial direction (e.g., generally along axis A) into the ejecting position when an ejecting force is applied to the holder 700. In the depicted implementation, at least a portion of the mouthend portion 812 comprises the collapsible section; however, in other implementations, the collapsible section may comprise various other locations along the length of a holder. In the depicted implementation, the collapsible section comprises a faceted area comprising a pattern of geometric shapes configured to collapse in the presence of a force. Referring back to FIG. 5, the faceted area of the depicted implementation also comprises a holding feature configured for placement of a user's finger or fingers while using the device.

Referring to FIG. 6, upon an ejecting force $F_E$ applied to the main body 800, the mouthend portion 812 of the depicted implementation is configured to collapse such that the proximal end 802 of the main body 800 moves toward the distal end 804. In such a manner, in the ejecting position of the depicted implementation, the main body 800 defines an ejecting length $L_E$ that is less than a length of the holder 700 in the use position $L_U$ (compare FIG. 6 to FIG. 5, which illustrates the use length $L_U$ of the holder 700). When the holder 700 of the depicted implementation is in the ejecting position, the mouthend portion 812 forms one or more collapsed nodes 820 at certain locations along the mouthend portion 812. Although in various implementations any number of collapsed nodes may be possible, including, for example, as few as one, in the depicted implementation two collapsed nodes 820 are formed.

In the depicted implementation, the mouthend portion 812 of the main body 800 also includes an internal plunger (not shown) that, in the use position, is either in contact with, or separated a distance from, a proximal end (e.g., the end opposite the heat source end) of the cartridge 300. When the proximal end 802 of the main body 800 of the depicted implementation moves toward the distal end 804 of the main body, the plunger presses against the proximal end of the cartridge 300 until the retaining features of the receiving chamber 810 no longer capture the cartridge 300, thus ejecting the cartridge 300 from the main body 800.

When no ejecting force $F_E$ is applied to the main body 800 of the depicted implementation (such as, for example, once the cartridge 300 has been ejected), the mouthend portion 812 is configured to return to the use position. In particular, when no ejecting force $F_E$ is applied to the main body 800 of the depicted implementation, the collapsed nodes 820 recede and/or straighten and the holder 700 assumes the use length $L_U$. In the depicted implementation, the mouthend portion 812 is made of an elastomeric polymer material configured to return to its original shape in the absence of force. In other implementations, the mouthend portion may be made of other materials, including, for example, one or more metal materials, and/or composite materials. In some implementations, the holder may include one or more internal features (such as, for example, one or more spring features) that may cause, or assist, in returning the main body to the use position.

In various implementations, the holder, or any components thereof, may be made of a moldable plastic material such as, for example, polycarbonate, polyethylene, acrylonitrile butadiene styrene (ABS), polyamide (Nylon), or polypropylene. In other implementations, the holder, or any of its components, may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, a fabric material, or any combinations thereof. In the depicted implementation, the holder is made of a combination of materials. For example, in the depicted implementation, the mouthend portion 812 is made of a moldable plastic material that is different than the material of the consumable portion 814. In other implementations, the mouthend portion and the consumable portion may be made of the same material. In some implementations, the colors of the various components of the holder may be the same. In other implementations, the colors of one or more of the components may differ from the colors of the other components. For example, in some implementations, the consumable portion may be one color, and the mouthend portion may be another color, which, in some implementations, may contrast with the color of the consumable portion.

FIG. 7 illustrates another example implementation of a holder 900 for use with a removable substrate cartridge 300. In the depicted implementation, the holder 900 includes a main body 1000 substantially aligned with axis A and that defines a proximal end 1002 and a distal end 1004. The holder 1000 also includes an internal aerosol passageway 1006 that extends from an opening 1008 at the proximal end 1002 of the main body 1000 to a receiving chamber 1010 configured to receive a portion of the consumable substrate cartridge 300. The internal passageway 1006 allows aerosol from an ignited cartridge to travel through the main body 1000 and through the opening 1008 for delivery to a user.

In the depicted implementation, the holder 900 includes one or more features configured to retain or temporarily "lock" the cartridge 300 in place within the holder 900 when the cartridge 300 is inserted into the receiving chamber 1010. In the depicted implementation, the receiving chamber 1010 includes at least portions of an elastomeric protuberance or ring (not shown) that extends radially inwardly and is configured to frictionally and/or sealingly engage an outer surface of the removable cartridge 300. In some implementations, the elastomeric protuberance or ring may be part of a sleeve that may be integral with the receiving chamber, such as, for example, as part of an over-molded part. In other implementations, other retaining features may be used. For example, in some implementations one or more retention spheres may form part of a cartridge retention assembly. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets. Combinations of two or more of these retaining features may also be used.

The holder 900 of the depicted implementation is shown in FIG. 7 in a use position, in which an inserted cartridge 300 may deliver aerosol to a user. In the depicted implementation, the use position also comprises a lighting position in which the heat source 308 of the cartridge 300 may be ignited (e.g., using a lighter or match). In other implementation, the lighting position may be different from the use position. In the use position of the depicted implementation, less than half of the length of the inserted cartridge 300 extends beyond (e.g., outside of) the distal end 1004 of the main body 1000. In particular, in the use position of the depicted implementation, the heat source 308 of an inserted cartridge 300 extends fully beyond (e.g., outside of) the distal end 1004 of the holder 900, while a majority of the remaining portion of the cartridge is located within (e.g., toward the proximal end 1002 of) the main body 1000. It should be noted that in other implementations, an inserted cartridge may have other configurations in a use position. For example, in the use position of some implementations, a majority of the length of an inserted cartridge may be located inside of the main body such that only a portion of the heat source of the cartridge extends outside of the main body. In the use position of other implementations, an inserted cartridge may be fully positioned within holder, such that no portion of the cartridge extends beyond the distal end of the main body. For example, in some of such implementations, a distal end of the inserted cartridge may substantially align with the distal end of the main body, or the distal end an inserted cartridge may be positioned closer to the proximal end of the main body than the distal end of the main body. In the use position of other implementations, an inserted cartridge may extend approximately halfway inside and halfway outside of the main body (e.g., the distal end of the main body may be proximate a location of an inserted cartridge that is the midpoint of the cartridge). In the use position of still other implementations, a majority (e.g., more than half) of the length of an inserted cartridge may extend beyond (e.g., outside of) the main body.

The holder of various implementations is configured to be held by a user. In the depicted implementation, the holder has a substantially cylindrical outer shape having a substantially circular cross-section. In other implementations, the holder may have any shape configured for handheld use. For example, the holder, or a portion thereof, of some implementations may have a non-cylindrical outer shape, such as, for example, a shape having a substantially oval or substantially oblong cross-section. In other implementations, the holder, or a portion thereof, may have an outer shape with a substantially rectangular or substantially square cross-section. In still other implementations, the holder, or a portion thereof, may have an outer shape with other polygonal cross-sections.

In some implementations, the holder may include additional features configured to aid in the handling and/or holding of the device. For example, the holder may include one or more grooves, nodes, depressions, etc. configured for placement of a user's finger or fingers while holding the device. Still other implementations need not include a holding feature.

In the depicted implementation, the holder 900 is also configured to have an ejecting position in which the cartridge 300 is ejected from the receiving chamber 1010 of the main body 1000. FIG. 8 illustrates the ejecting position of the holder 900 of FIG. 7. In the depicted implementation, the main body 1000 of the holder 900 includes a deflectable portion 1005 that includes the distal end 1004 of the main body 1000. In the depicted implementation, the deflectable portion 1005 forms at least a part of the receiving chamber 1010 when in a use position. In the ejecting position, however, the deflectable portion 1005 is configured to rotate relative to the remaining main body 1000. In particular, the deflectable portion 1005 of the depicted implementation is configured to rotate about axis B into the ejecting position. In the depicted implementation, there is one deflectable portion; however, in other implementations there may be more than one deflectable portion. For example, in some implementations, there may be two, three, four, or more deflectable portions.

In the depicted implementation, the deflectable portion 1005 defines an inward rotating side 1007 located on the proximal side of the rotation axis B (e.g., toward the proximal end 1002 of the main body 1000) and an outward rotating side 1009 located on the distal side of the rotating axis B (e.g., toward the distal end 1004 of the main body 1000). Upon an ejecting force $F_E$ applied to the inward rotating side 1007, the outward rotating side 1009 rotates relative to the remaining portion of the main body 1000. As such, when an ejecting force $F_E$ is applied to inward rotating side 1007, the outward rotating side 1009 rotates outward and away from the remaining portion of the main body 1000.

Because the deflectable portion 1005 defines a part of the receiving chamber 1010, when the outward rotating side 1009 of the deflectable portion 1005 rotates outward, the retaining features of the receiving chamber 1010 no longer capture the cartridge 300, thus ejecting the cartridge 300 from the main body 1000. In such a manner, a force may also be applied to the inward rotating side 1007 of the deflectable portion 1005 in order to insert or load a replacement cartridge. In the depicted implementation, the ejecting force $F_E$ is applied substantially perpendicular to the longitudinal axis A; however, in other implementations the ejecting force may be applied substantially non-perpendicular to the longitudinal axis.

When no ejecting force $F_E$ is applied to the main body 1000 of the depicted implementation (such as, for example, once the cartridge 300 has been ejected), the deflectable portion 1005 returns to the use position. In particular, the depicted implementation includes an internal return spring 1111 configured to return the deflectable portion 1005 back to the use position when no ejecting force $F_E$ is applied to the main body 1000. Other implementations, however, need not include an internal return spring. For example, in some implementations, the deflectable portion may be made of a material configured to return to its original shape in the absence of a force. In other implementations, other mechanisms may be configured to return the deflectable portion back to the use position.

In various implementations, the holder, or any components thereof, may be made of a moldable plastic material such as, for example, polycarbonate, polyethylene, acrylonitrile butadiene styrene (ABS), polyamide (Nylon), or polypropylene. In other implementations, the holder, or any of its components, may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, a fabric material, or any combinations thereof.

FIG. 9 illustrates another example implementation of a holder 1100 for use with a removable substrate cartridge 300. In the depicted implementation, the holder 1100 includes a main body 1200 substantially aligned with axis A and that defines a proximal end 1202 and a distal end 1204. The holder 1200 also includes an internal aerosol passageway 1206 that extends from an opening 1208 at the proximal end 1202 of the main body 1200 to a receiving chamber 1210 configured to receive a portion of the consumable substrate cartridge 300. The internal passageway 1206 allows aerosol from an ignited cartridge to travel through the main body 1200 and through the opening 1208 for delivery to a user.

In the depicted implementation, the holder 1100 includes one or more features configured to retain or temporarily "lock" the cartridge 300 in place within the holder 1100 when the cartridge 300 is inserted into the receiving chamber 1210. In the depicted implementation, the receiving chamber 1210 includes at least portions of an elastomeric protuberance or ring (not shown) that extends radially inwardly and is configured to frictionally and/or sealingly engage an outer surface of the removable cartridge 300. In some implementations, the elastomeric protuberance or ring may be part of a sleeve that may be integral with the receiving chamber, such as, for example, as part of an over-molded part. In other implementations, other retaining features may be used. For example, in some implementations one or more retention spheres may form part of a cartridge retention assembly. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets. Combinations of two or more of these retaining features may also be used.

The holder 1110 of the depicted implementation is shown in FIG. 9 in a use position, in which an inserted cartridge 300 may deliver aerosol to a user. In the depicted implementation, the use position also comprises a lighting position in which the heat source 308 of the cartridge 300 may be ignited (e.g., using a lighter or match). In other implementation, the lighting position may be different from the use position. In the use position of the depicted implementation, less than half of the length of the inserted cartridge 300 extends beyond (e.g., outside of) the distal end 1204 of the main body 1200. In particular, in the use position of the depicted implementation, the heat source 308 of an inserted cartridge 300 extends fully beyond (e.g., outside of) the distal end 1204 of the holder 1100, while a majority of the remaining portion of the cartridge is located within (e.g., toward the proximal end 1202 of) the main body 1200. It should be noted that in other implementations, an inserted cartridge may have other configurations in a use position. For example, in the use position of some implementations, a majority of the length of an inserted cartridge may be located inside of the main body such that only a portion of the heat source of the cartridge extends outside of the main body. In the use position of other implementations, an inserted cartridge may be fully positioned within holder, such that no portion of the cartridge extends beyond the distal end of the main body. For example, in some of such implementations, a distal end of the inserted cartridge may substantially align with the distal end of the main body, or the distal end an inserted cartridge may be positioned closer to the proximal end of the main body than the distal end of the main body. In the use position of other implementations, an inserted cartridge may extend approximately halfway inside and halfway outside of the main body (e.g., the distal end of the main body may be proximate a location of an inserted cartridge that is the midpoint of the cartridge). In the use position of still other implementations, a majority (e.g., more than half) of the length of an inserted cartridge may extend beyond (e.g., outside of) the main body.

The holder of various implementations is configured to be held by a user. In the depicted implementation, the holder has a substantially cylindrical outer shape having a substantially circular cross-section. In other implementations, the holder may have any shape configured for handheld use. For example, the holder, or a portion thereof, of some implementations may have a non-cylindrical outer shape, such as, for example, a shape having a substantially oval or substantially oblong cross-section. In other implementations, the holder, or a portion thereof, may have an outer shape with a substantially rectangular or substantially square cross-section. In still other implementations, the holder, or a portion thereof, may have an outer shape with other polygonal cross-sections.

In some implementations, the holder may include additional features configured to aid in the handling and/or holding of the device. In the depicted implementation, for example, the holder 120 includes an extended groove 1218 configured for placement of a user's finger or fingers while using the device. In the depicted implementation, the extended groove 1218 comprises an area of decreased outer diameter that includes a smooth and extended transition from the outer diameter of the portions of the main body 1200 on either side thereof. In such a manner, the main body 1200 of the depicted implementation may have a substantially hourglass shape when in the use position. In other implementations, other features configured for assisting a user with holding and using the device may be included, alternatively or additionally. Still other implementations need not include a groove. In other implementations, rather than a groove (or in addition to a groove), the holder may include one or more discrete, localized areas of increased outer diameter (e.g., nodes) or other discrete, localized areas of decreased diameter (e.g., depressions) located at any location along the length of the holder. Still other implementations need not include any areas of increased outer diameter. In the depicted implementation, at least a portion of the main body 1200 includes a textured surface that may further aid in the handling and/or holding of the device.

In the depicted implementation, the holder 1100 is also configured to have an ejecting position in which the cartridge 300 is ejected from the receiving chamber 1210 of the main body 1200. FIG. 10 illustrates the ejecting position of the holder 1100 of FIG. 9. In the depicted implementation, the main body 1200 of the holder 1100 includes a pair of opposing deflectable portions 1205 that include the distal end 1204 of the main body 1200. In the depicted implementation, the deflectable portions 1205 form at least a part of the receiving chamber 1210 when in a use position. In the ejecting position, however, the deflectable portions 1205 are configured to rotate relative to the remaining main body 1200. In particular, the deflectable portions 1205 of the depicted implementation are configured to rotate about axis B into the ejecting position. In the depicted implementation, there are a pair of deflectable portions; however, as noted above in other implementations there may be less or more deflectable portions.

In the depicted implementation, the deflectable portions 1205 define respective inward rotating sides 1207 located on the proximal side of the rotation axis B (e.g., toward the proximal end 1202 of the main body 1200) and outward rotating sides 1209 located on the distal side of the rotating axis B (e.g., toward the distal end 1204 of the main body 1200). Upon ejecting forces $F_E$ applied to the inward rotating sides 1207, the outward rotating sides 1209 rotate relative to the remaining portion of the main body 1200. As such, when the ejecting forces $F_E$ are applied to inward rotating sides 1207, the outward rotating sides 1209 rotate outward and away from the remaining portion of the main body 1200. Because the deflectable portions 1205 define a part of the receiving chamber 1210, when the outward rotating sides 1209 of the deflectable portion 1205 rotate outward, the retaining features of the receiving chamber 1210 no longer capture the cartridge 300, thus ejecting the cartridge 300 from the main body 1200. In such a manner, forces may also be applied to the inward rotating sides 1207 of the deflectable portions 1205 in order to insert or load a replacement cartridge. In the depicted implementation, the ejecting forces $F_E$ are applied substantially simultaneously (e.g., by pinching the respective inward rotating sides 1207); however, in other implementations the ejecting forces may be applied substantially non-simultaneously. In the depicted implementation, the ejecting forces $F_E$ are applied substantially perpendicular to the longitudinal axis A; however, in other implementations the ejecting forces may be applied substantially non-perpendicular to the longitudinal axis.

When no ejecting forces $F_E$ are applied to the main body 1200 of the depicted implementation (such as, for example, once the cartridge 300 has been ejected), the deflectable portions 1205 return to the use position. In particular, the depicted implementation includes at least one internal return spring 1121 configured to return the deflectable portions 1205 back to the use position when no ejecting forces $F_E$ are applied to the main body 1200. Other implementations, however, need not include an internal return spring. For example, in some implementations, the deflectable portions may be made of a material configured to return to their original shape in the absence of a force. In other implementations, other mechanisms may be configured to return the deflectable portions back to the use position.

In various implementations, the holder, or any components thereof, may be made of a moldable plastic material such as, for example, polycarbonate, polyethylene, acrylonitrile butadiene styrene (ABS), polyamide (Nylon), or polypropylene. In other implementations, the holder, or any of its components, may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, a fabric material, or any combinations thereof.

FIG. 11 illustrates a perspective view of the removable cartridge 300, according to an example implementation of the present disclosure. In the depicted implementation, the cartridge 300 defines a first end 302 and a distal end 304. The cartridge 300 of the depicted implementation further includes a heat portion 306, which comprises a heat source 308, a substrate portion 310, which comprises a substrate material 316 (see FIG. 12), and an outer housing 312 configured to circumscribe the heat source 308 and the substrate material 316. It should be noted that although in the depicted implementation the cartridge 300 has a substantially cylindrical overall shape, in various other implementations, the cartridge or any of its components, may have a different shape. For example, in some implementations the cartridge (and/or any of its components) may have a substantially rectangular shape, such as a substantially rectangular cuboid shape. In other implementations, the cartridge (and/or any of its components) may have other hand-held shapes. Some examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

In some implementations, a barrier may exist between the heat source and the substrate material. In some implementations, such a barrier may comprise a disc that may include one or more apertures therethrough. In some implementations, the barrier may be constructed of a metal material (such as, for example, stainless steel, aluminum, brass, copper, silver, gold, bronze, titanium, various alloys, etc.), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. Pat. App. Pub. No. 2019/0281891 to Hejazi et al., which is incorporated herein by reference in its entirety. In some implementations, a barrier and/or a heat transfer component may prevent or inhibit combustion gasses from being drawn through the substrate material (and/or from being drawn through air passageways through which aerosol is drawn).

In various implementations, the heat source may be configured to generate heat upon ignition thereof. In the depicted implementation, the heat source 308 comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Some carbonaceous materials may be composed predominately of carbon, and/or typically have carbon contents of greater than about 60 percent, generally greater than about 70 percent, often greater than about 80 percent, and frequently greater than about 90 percent, on a dry weight basis.

As noted above, the heat source 308 of the cartridge 300 of the depicted implementation comprises a susceptor material configured to be heated by the resonant transmitter. In some implementations, the heat source material itself (e.g., a carbon material) may comprise a susceptor material. In other implementations, a susceptor material may be added to the heat source. In some implementations, the susceptor material may comprise a ferromagnetic material including, but not limited to, cobalt, iron, nickel, zinc, manganese, and any combinations thereof. In some implementations, one or more of the susceptor components may be made of other materials, including, for example, other metal materials such as aluminum or stainless steel, as well as ceramic materials such as silicon carbide, and any combinations of any of the materials described above. In still other implementations, the susceptor material may comprise other conductive materials including metals such as copper, alloys of conductive materials, or other materials with one or more conductive materials imbedded therein. In some implementations, the susceptor material may comprise a granulated susceptor component, including, but not limited to a shredded susceptor material. In other implementations, a granulated susceptor component may comprise susceptor particles, susceptor beads, etc.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible. Although specific dimensions of an applicable heat source may vary, in the depicted implementation, the heat source 308 has a length in an inclusive range of approximately 5 mm to approximately 20 mm, and in some implementations may be approximately 12 mm, and an overall diameter in an inclusive range of approximately 3 mm to approximately 8 mm, and in some implementations may be approximately 4.8 mm (and in some implementations, approximately 7 mm).

Although in other implementations the heat source may be constructed in a variety of ways, in the depicted implementation, the heat source 308 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

In various implementations the heat source may have a variety of forms, including, for example, a substantially solid cylindrical shape or a hollow cylindrical (e.g., tube) shape. In other implementations, the heat source may comprise a plurality of hollow or substantially solid spheres, which in some implementations may comprise substantially the same size, and in other implementations may comprise more than one size. In various implementations, the heat source may be made in variety of ways, including, but not limited to, via extrusion, injection molding, compression molding, etc. The heat source 308 of the depicted implementation comprises an extruded monolithic carbonaceous material that has a generally cylindrical shape that includes a plurality of internal passages 314 (see FIG. 12) extending longitudinally from a first end of the heat source 308 to an opposing second end of the heat source 308. In the depicted implementation, the outer housing 312 is configured to circumscribe the entire heat source 308 and substrate material 316. In other implementations, however, the outer housing may circumscribe only a portion of the heat source (see e.g., FIGS. 13 and 14). In the depicted implementation, the outer housing 312 of the cartridge 300 includes a plurality of end openings 315 and peripheral openings 317 located on the end of the outer housing 312 proximate the heat source 308. Although in other implementations the size and shape of the end and peripheral openings may differ, the end openings 315 of the depicted implementation comprise a plurality of elongate rounded slots radially extending from a central area of the end of the outer housing 312, and the peripheral openings 317 comprise a plurality of aligned rows of substantially circular openings. In the depicted implementation, one or more of the end openings 315 are in fluid communication with one or more of the internal passages 314 of the heat source 308. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. Pat. App. Pub. No. 2019/0254335 to Spicer et al., which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 12 illustrates a longitudinal cross-section view of the cartridge 300 of FIG. 11. As shown in the figure, the substrate material 316 of the depicted implementation has opposed first and second ends, with the heat source 308 disposed adjacent the first end of the substrate material 316. Although dimensions and cross-section shapes of the various components of the cartridge may vary due to the needs of a particular application, in the depicted implementation the cartridge 300 may have an overall length in an inclusive range of approximately 10 mm to approximately 50 mm and a diameter in an inclusive range of approximately 2 mm to approximately 20 mm. In addition, in the depicted implementation the outer housing 312 may have a thickness in the inclusive range of approximately 0.05 mm to 0.5 mm. Furthermore, in the depicted implementation the substrate portion 310 may have a length in the inclusive range of approximately 5 mm to 30 mm and a diameter slightly less than that of the overall cartridge in order to accommodate the thickness of the housing 312, such as, for example, a diameter in an inclusive range of approximately 2.9 mm to approximately 9.9 mm. In the depicted implementation, the substrate material 316 comprises tobacco beads, which may have diameter sizes in range of approximately 0.5 mm to 2.0 mm, although in other implementations the size may differ. In other implementations, the substrate material may be a granulated tobacco material or cut filler tobacco. Although other implementations may differ, in the depicted implementation the outer housing 312 of the cartridge 300 is filled to about 60-90% capacity to allow for insertion of the heat source 308.

In the depicted implementation, the substrate portion 310 comprises a substrate material 316 having a single segment, although in other implementations the substrate portion may include one or more additional substrate material segments. For example, in some implementations, the aerosol delivery device may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 316 of the depicted implementation).

In various implementations, ignition of the heat source of a cartridge heats the heat source, which in turn heats the substrate material ultimately resulting in aerosolization of the aerosol precursor composition associated with the substrate material. As noted, in various implementations the holder may include an aerosol passageway that extends therethrough. As such, upon a draw applied to the proximal end of the holder, aerosol generated by the cartridge 300 is configured to be delivered to a user. In some implementations, the aerosol passageway extends from the cartridge receiving chamber to the mouthpiece portion of the holder in a substantially direct path. For example, in some implementations, the aerosol passageway may extend from the cartridge receiving chamber through the holder along a path that is aligned with, or substantially parallel to, a longitudinal axis thereof. In other implementations, however, the aerosol passageway may have a less direct route. For example, the aerosol passageway of some implementations may define an indirect route from the cartridge receiving chamber through the holder, such as, for example, via one or more tortuous paths. In some implementations, for example, such a path may allow the aerosol to cool before reaching a user. In some implementations, such a path may allow mixing of the aerosol with air from outside of the holder. In some implementations, such a path may comprise a serpentine pattern. In other implementations, such a path may include one or more sections that overlap and/or double back toward each other. In other implementations, such a path may comprise one or more spiral turns that extend around an inner diameter of the holder. Other implementations may include combinations of tortuous aerosol paths. Still other implementations may include combinations of direct and tortuous path sections.

In some implementations, the mouthpiece portion, or other portion of the holder may include a filter configured to receive the aerosol therethrough in response to the draw applied to the holder. In various implementations, the filter may be provided, in some aspects, as a circular disc radially and/or longitudinally disposed proximate the end of the holder opposite the receiving end. In this manner, upon a draw on the holder, the filter may receive the aerosol flowing through holder. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the mouthpiece portion may include a filter that may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. Pat. App. Pub. No. 2019/0289909 to Hejazi; and U.S. Pat. App. Pub. No. 2020/0288787 to Hejazi, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the cartridge 300 of the depicted implementation, the substrate material 316 comprises a plurality of tobacco beads together formed into a substantially cylindrical portion. In various implementations, however, the substrate material may comprise a variety of different compositions and combinations thereof, as explained in more detail below.

In various implementations, the substrate material may comprise a tobacco material, a non-tobacco material, or a combination thereof. In one implementation, for example, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. Pat. App. Pub. No. 2019/0261685 to Sebastian et al., which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No.

6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., Fund. Appl. Toxicol., 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally, or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Some casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. Pat. App. Pub. No. 2020/0113239 to Aller et al., which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to, eucolyptol or WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

In the depicted implementation, the substrate material 316 may comprise a centrally defined longitudinally extending axis between the opposed first and second ends, and a cross-section of the substrate material 316 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

In the depicted implementation, the outer housing comprises a rigid material. For example, the outer housing 312 of the depicted implementation is constructed of an aluminum material; however, in other implementations, the outer housing may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Pub. No. 2020/0128880 to Gage et al., which is incorporated herein by reference in its entirety.

In the depicted implementation, the outer housing 312 is constructed as a tube structure that substantially encapsulates the heat source 308 and the substrate material 316; however, as noted above, in other implementations the outer housing may have other shapes. Although the shape of the outer housing may vary, in the depicted implementation the outer housing 312 comprises a tube structure having opposed closed ends with openings defined therethrough. In particular, in addition to the heat source end openings 315, 317, the depicted implementation of the outer housing 312 also includes one or more end apertures 318 located on the opposite closed end that are configured to allow aerosolized vapor (herein alternatively referred to as a "vapor" or "aerosol") to pass therethrough. The end apertures 318 of the depicted implementation are in the form of a pair of elongate rounded slots; however, in other implementations the end apertures may have any form that permits passage of the aerosol therethrough. As such, it will be appreciated that the end apertures 318 can comprise fewer or additional apertures and/or alternative shapes and sizes of apertures than those illustrated.

FIG. 13 illustrates a perspective view of a removable cartridge 400, according to another example implementation of the present disclosure, which is usable with any of the holder implementations described or contemplated herein. In the depicted implementation, the cartridge 400 defines a first end 402 and a distal end 404. The cartridge 400 of the depicted implementation further includes a heat portion 406, which comprises a heat source 408, a substrate portion 410, which comprises a substrate material 416 (see FIG. 14), and an outer housing 412 configured to circumscribe at least a portion of the heat source 408 and the substrate material 416. It should be noted that although in the depicted implementation the cartridge 400 has a substantially cylindrical overall shape, in various other implementations, the cartridge or any of its components may have a different shape. For example, in some implementations the cartridge (and/or any of its components) may have a substantially rectangular shape, such as a substantially rectangular cuboid shape. In other implementations, the cartridge (and/or any of its components) may have other hand-held shapes. Some examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

As noted above, in some implementations, a barrier may exist between the heat source and the substrate material. Reference is made to the discussion above with regard to possible configurations and/or materials of a barrier. In some implementations, such a barrier may comprise a disc that may include one or more apertures therethrough. In some implementations, the barrier may be constructed of a metal material (such as, for example, stainless steel, aluminum, brass, copper, silver, gold, bronze, titanium, various alloys, etc.), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. Pat. App. Pub. No. 2019/0281891 to Hejazi et al., which is incorporated herein by reference in its entirety. In some implementations, a barrier and/or a heat transfer component may prevent or inhibit combustion gasses from being drawn through the substrate material (and/or from being drawn through air passageways through which aerosol is drawn).

In various implementations, the heat source may be configured to generate heat upon ignition thereof. In the depicted implementation, the heat source 408 comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Some carbonaceous materials may be composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible. Although specific dimensions of an applicable heat source may vary, in the depicted implementation, the heat source 408 has a length in an inclusive range of approximately 5 mm to approximately 20 mm, and in some implementations may be approximately 12 mm, and an overall diameter in an inclusive range of approximately 3 mm to approximately 8 mm, and in some implementations may be approximately 4.8 mm (and in some implementations, approximately 7 mm).

Although in other implementations the heat source may be constructed in a variety of ways, in the depicted implementation, the heat source 408 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

In various implementations, the heat source may have a variety of forms, including, for example, a substantially solid cylindrical shape or a hollow cylindrical (e.g., tube) shape. In other implementations, the heat source may comprise a plurality of hollow or substantially solid spheres, which in some implementations may comprise substantially the same size, and in other implementations may comprise more than one size. In various implementations, the heat source may be made in variety of ways, including, but not limited to, via extrusion, injection molding, compression molding, etc. The heat source 408 of the depicted implementation comprises an extruded monolithic carbonaceous material that has a generally cylindrical shape that includes a plurality of internal passages 614 extending longitudinally from a first end of the heat source 408 to an opposing second end of the heat source 408. In the depicted implementation there are approximately thirteen internal passages 414 comprising a single central internal passage 414*a*, six surrounding internal passages 414*b*, which are spaced from the central internal passages 414*a* and have a similar size (e.g., diameter) to that of the central internal passage 414*a*, and six peripheral internal passages 414*c*, which are spaced from an outer surface of the heat source 408 and are smaller in diameter than that of the central internal passage 414*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. Pat. App. Pub. No. 2019/0254335 to Spicer et al., which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 14 illustrates a longitudinal cross-section view of the cartridge 400 of FIG. 13. As shown in the figure, the substrate material 416 of the depicted implementation has opposed first and second ends, with the heat source 408 disposed adjacent the first end of the substrate material 416. Although dimensions and cross-section shapes of the various components of the cartridge may vary due to the needs of a particular application, in the depicted implementation the cartridge 400 may have an overall length in an inclusive range of approximately 10 mm to approximately 50 mm and a diameter in an inclusive range of approximately 2 mm to approximately 20 mm. In addition, in the depicted implementation the outer housing 412 may have a thickness in the inclusive range of approximately 0.05 mm to 0.5 mm. Furthermore, in the depicted implementation the substrate portion 410 may have a length in the inclusive range of approximately 5 mm to 30 mm and a diameter slightly less than that of the overall cartridge in order to accommodate the thickness of the housing 412, such as, for example, a diameter in an inclusive range of approximately 2.9 mm to approximately 9.9 mm. In the depicted implementation, the substrate material 416 comprises tobacco beads, which may have diameter sizes in range of approximately 0.5 mm to 2.0 mm, although in other implementations the size may differ. In other implementations, the substrate material may be a granulated tobacco material or cut filler tobacco. Although other implementations may differ, in the depicted implementation the outer housing 412 of the cartridge 400 is filled to about 80-90% capacity to allow for insertion of the heat source 408.

In the depicted implementation, the substrate portion 410 comprises a substrate material 416 having a single segment, although in other implementations the substrate portion may include one or more additional substrate material segments. For example, in some implementations, the aerosol delivery device may further comprise a second substrate material segment (not shown) having opposed first and second ends. As described above, in various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions and/or components for use in a substrate material (and/or substrate materials) are described above. Reference is also made to the discussion above regarding various possible shapes, aerosol precursor compositions, additives, flavorants, etc. of the substrate material.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the cartridge 400 of the depicted implementation, the substrate material 416 comprises a plurality of tobacco beads together formed into a substantially cylindrical portion. In various implementations, however, the substrate material may comprise a variety of different compositions and combinations thereof, as explained in more detail below.

In the depicted implementation, the substrate material 416 may comprise a centrally defined longitudinally extending axis between the opposed first and second ends, and a cross-section of the substrate material 416 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

As shown in FIGS. 13 and 14, the outer housing 412 of the cartridge 400 of the depicted implementation is configured to circumscribe the substrate portion 410, including the substrate material 416. In the depicted implementation, the outer housing 412 is also configured to circumscribe only a portion of the heat source 408. In some implementations, however, the outer housing may circumscribe the entire heat source (see e.g., FIGS. 9 and 10). In the depicted implementation, the outer housing comprises a rigid material. For example, the outer housing 412 of the depicted implementation is constructed of an aluminum material; however, in other implementations the outer housing may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Pub. No. 2020/0128880 to Gage et al., which is incorporated herein by reference in its entirety.

In the depicted implementation, the outer housing 412 is constructed as a tube structure that substantially encapsulates the substrate material 416; however, as noted above, in other implementations the outer housing may have other shapes. Although the shape of the outer housing may vary, in the depicted implementation the outer housing 412 comprises a tube structure having an open end and a closed end. The depicted implementation of the outer housing 412 also includes one or more end apertures 418 located on the closed end of the outer housing 412 that are configured to allow aerosolized vapor (herein alternatively referred to as a "vapor" or "aerosol") to pass therethrough. The end apertures 418 of the depicted implementation are in the form of a pair of elongate rounded slots; however, in other implementations the end apertures may have any form that permits passage of the aerosol therethrough. As such, it will be appreciated that the end apertures 418 can comprise fewer or additional apertures and/or alternative shapes and sizes of apertures than those illustrated.

As described above, the holder of various implementations of the present disclosure is configured to move to and from a loading position, and/or a use position, and/or a lighting position. In some implementations, the holder may also have an extinguishment position. In such a manner, the extinguishment position may be configured such that the heat source of a cartridge is deprived of sufficient oxygen to sustain combustion. In some implementations, the extinguishment position may be obtained by a further action of the holder. In other implementations, one or more additional features may be included such that an extinguishment position may be achieved by actuating the one or more additional features. In particular, the holder of one implementation may include an air impermeable cover feature located proximate the distal end of the holder that may be mechanically or manually actuatable (e.g., by rotating the cover feature over the end of the main body and/or by sliding the cover feature across the end of the main body) such that in the extinguishment position, the cover feature substantially covers the open end of the holder and the heat source of the cartridge is deprived of sufficient oxygen to sustain combustion. In another implementation, the holder may include a detachable feature, such as, for example, an end cap, that may be used to achieve the extinguishment position. For example, in some implementations a separate end cap may be attachable over the distal end of the holder such that, once attached, the heat source of the cartridge is deprived of sufficient oxygen to sustain combustion. Such an end cap could also be used to cover the end of the second body portion when not in use, such as, for example, to prevent dirt and/or foreign objects from entering into the device. Additionally, or alternatively, in some implementations the holder of the present disclosure may include an air permeable cover feature (e.g., a cover feature comprising a plurality of openings or a cover feature comprising a mesh) that protects the heat source of the cartridge in the use position. For example, the holder of one implementation may include an air permeable cover feature located proximate the distal end of the holder that may be mechanically or manually actuatable (e.g., by rotating the cover feature over the end of the holder and/or by sliding the cover feature across the end of the holder) such that once ignited, the cover feature may be actuated to substantially cover the open end of the holder while maintaining sufficient access of oxygen to the heat source.

In the depicted implementations, the holder includes walls that are substantially solid and non-porous; however, in other implementations one or more of these walls of a holder may have other configurations. For example, in some implementations one or more of the walls of a holder may be non-solid and/or substantially porous or may include one or more non-solid and/or substantially porous portions. In some implementations, for example, the holder may include one or more apertures that may facilitate access of oxygen to the heat source. Alternatively, or additionally, other implementations may include one or more apertures that may mix with the aerosol generated during a draw. In such a manner, in the use position the one or more apertures may be located proximate the heat source, thus providing the heat source with additional access to oxygen during combustion. In some implementations, the holder may include one or more apertures downstream from the heat source. For example, in some implementations the holder may include apertures that extend into the aerosol passage of the holder that may mix with aerosol generated by the substrate material of the cartridge.

In various implementations, the present disclosure may also be directed to kits that provide a variety of components as described herein. For example, a kit may comprise a holder with one or more cartridges. In another implementation, a kit may comprise a plurality of holders. In further implementations, a kit may comprise a plurality of cartridges. In yet another implementation, a kit may comprise a plurality of holders and a plurality of cartridges. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a cartridge receiving chamber of the holder, or, in other implementations, inserted in a separate aperture that enables a user to remove debris from the cartridge receiving chamber.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A holder for use with a removable substrate cartridge, the holder comprising:

a main body having a proximal end and a distal end and defining a use length in a use position, the main body further comprising:

a receiving chamber configured to receive at least a portion of a removable substrate cartridge;

an aerosol passageway that extends from the receiving chamber through the main body; and a collapsible section defined between the proximal end and distal end of the main body, wherein the collapsible section is configured to collapse in an axial direction into an ejecting position when an ejecting force is applied to one or both of the proximal end or the distal end of the main body, the main body further defining an ejecting length in the ejecting position, wherein the ejecting length is less than the use length, and wherein the collapsible portion is further configured to return to the use position when no ejecting force is applied to the main body, wherein in the ejecting position, at least a portion of the collapsible section increases in outer diameter with respect to other portions of the holder and the removable substrate cartridge is ejected from the main body.

2. The holder of claim 1, wherein the main body further comprises an internal receiving member that includes the receiving chamber.

3. The holder of claim 1, wherein the main body further comprises a mouthend portion that includes the proximal end, a consumable end portion that includes the distal end, and an intermediate portion located between the mouthend portion and the consumable portion, and wherein the intermediate portion comprises the collapsible section.

4. The holder of claim 1, wherein the main body further comprises a mouthend portion that includes the proximal end and a consumable portion that includes the distal end, and wherein the mouthend portion comprises the collapsible section.

5. The holder of claim 1, wherein the main body further comprises a mouthend portion that includes the proximal end and a consumable portion that includes the distal end, and wherein the consumable portion comprises the collapsible section.

6. The holder of claim 1, wherein the collapsible section forms at least one collapsed node in the ejecting position.

7. The holder of claim 1, wherein the collapsible section forms a plurality of collapsed nodes in the ejecting position.

8. The holder of claim 1, wherein the main body includes at least one stationary node and/or groove.

9. The holder of claim 1, wherein the main body further includes an internal plunger, and wherein when the ejecting force is applied to one or both of the proximal end or the distal end of the main body, the internal plunger is configured to eject the removable substrate cartridge from the receiving chamber.

10. The holder of claim 9, wherein the main body comprises a mouthend portion that includes the proximal end and a consumable portion that includes the distal end, and wherein the internal plunger is connected to the mouthend portion.

* * * * *